US010002482B2

(12) United States Patent
Kamada et al.

(10) Patent No.: US 10,002,482 B2
(45) Date of Patent: Jun. 19, 2018

(54) COIN-ROLL EJECTING DEVICE, MONEY PROCESSING MACHINE AND COIN-ROLL EJECTION METHOD

(71) Applicant: GLORY LTD., Himeji-shi, Hyogo (JP)

(72) Inventors: Youhei Kamada, Himeji (JP); Yasushi Yokota, Himeji (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days. days.

(21) Appl. No.: 15/309,386

(22) PCT Filed: Apr. 23, 2015

(86) PCT No.: PCT/JP2015/062390

§ 371 (c)(1),
(2) Date: Nov. 7, 2016

(87) PCT Pub. No.: WO2015/170598

PCT Pub. Date: Nov. 12, 2015

(65) Prior Publication Data

US 2017/0076529 A1 Mar. 16, 2017

(30) Foreign Application Priority Data

May 8, 2014 (JP) ..... 2014-096542

(51) Int. Cl.
*G07D 1/00* (2006.01)
*G07D 9/00* (2006.01)

(52) U.S. Cl.
CPC ..... *G07D 1/00* (2013.01); *G07D 9/00* (2013.01); *G07D 9/002* (2013.01)

(58) Field of Classification Search
CPC ..... G07D 1/00; G07D 9/00; G07D 9/002
(Continued)

(56) References Cited

U.S. PATENT DOCUMENTS 3,604,432 A * 9/1971 McCollough ..... G07D 9/04 453/31
4,469,245 A * 9/1984 Fish ..... G07D 1/04 221/155

(Continued)

FOREIGN PATENT DOCUMENTS

JP 58-146987 A 9/1983
JP 3456851 B2 7/1998

(Continued)

OTHER PUBLICATIONS

International Search Report (International Application No. PCT/JP2015/062390) (2 pages—dated Jun. 9, 2015).

(Continued)

*Primary Examiner* — Michael Collins
(74) *Attorney, Agent, or Firm* — Renner, Kenner, Greive, Bobak, Taylor & Weber

(57) ABSTRACT

A coin-roll ejecting device (1) includes a storing unit (10) that stores therein a plurality of rolls of coins and having an ejecting mechanism (19) for ejecting the stored rolls of coins one by one; an ejected coin-roll detecting unit (84) that detects a roll of coins ejected from the storing unit (10) by the ejecting mechanism (19); and a controlling unit (70) that determines whether a roll of coins is present in the storing unit (10) based on a detection result of the roll of coins obtained by the ejected coin-roll detecting unit (84).

16 Claims, 13 Drawing Sheets

(58) Field of Classification Search
USPC ..... 700/231–244
See application file for complete search history.

(56) References Cited

U.S. PATENT DOCUMENTS 4,717,044 A * 1/1988 Suzuki ..... G07F 11/32 221/130
4,840,290 A * 6/1989 Nakamura ..... G07D 9/00 221/10
4,940,162 A * 7/1990 Thie ..... G07F 11/32 221/129
5,830,055 A * 11/1998 Jones ..... G07D 9/002 221/197
5,848,725 A * 12/1998 Saeki ..... B65G 47/1407 221/131
6,095,369 A * 8/2000 Jenkins ..... G07D 1/00 221/253
6,206,234 B1 * 3/2001 Rawlins ..... G07F 11/007 221/123
6,340,095 B1 * 1/2002 Walter ..... G07D 11/0018 221/123
7,111,754 B1 * 9/2006 Siemens ..... G07D 1/00 221/200
7,571,833 B2 * 8/2009 Smith ..... G07D 1/00 221/123
2006/0054455 A1 * 3/2006 Kuykendall ..... G07F 9/08 194/217
2009/0076650 A1 * 3/2009 Faes ..... G07F 11/165 700/232
2009/0171498 A1 * 7/2009 Tabata ..... G07D 1/02 700/214
2016/0284151 A1 * 9/2016 Fujimura ..... G07D 1/04

FOREIGN PATENT DOCUMENTS

JP 11-259717 A 9/1999
JP 11-288479 A 10/1999
JP 2003-137434 A 5/2003
JP 2006-309468 A 11/2006

OTHER PUBLICATIONS

Written Opinion of the International Searching Authority (International Application No. PCT/JP2015/062390) (7 pages—dated Jun. 9, 2015).
Japanese Office Action with English Translation (Japanese Patent Application No. 2014-096542) (8 pages—dated Oct. 11, 2017).
European Search Report (Application No. 15789138.3 (PCT/JP2015/062390) (10 pages—dated Feb. 3, 2018)

* cited by examiner

COIN-ROLL EJECTING DEVICE, MONEY PROCESSING MACHINE AND COIN-ROLL EJECTION METHOD

TECHNICAL FIELD

The present invention relates to a coin-roll ejecting device for ejecting a roll of coins stored inside a housing thereof to the outside of the housing, a money processing machine including the coin-roll ejecting device, and a coin-roll ejecting method implemented on the coin-roll ejecting device.

BACKGROUND ART

Various types of coin-roll ejecting devices for ejecting rolls of coins stored inside a housing thereof to the outside of the housing are currently in use. Moreover, Japanese Patent No. 3456851 discloses a method of detecting the number and the denomination of the rolls of coins that have been stored in a storing unit of a coin-roll ejecting device. In a coin-roll detecting mechanism disclosed in Japanese Patent No. 3456851, in addition to a sensor that scans with a sensing light an edge portion on a fringe side away from a central part of an end face of a roll of coins in a cassette for storing the roll of coins, a sensor that scans with a sensing light the central part of the end face of the roll of coins in the cassette is provided. The number and the denomination of the rolls of coins are detected based on a length, i.e., a diameter, of the edge portion of the roll of coins and presence/absence of a hole in the roll of coins.

SUMMARY OF INVENTION

In the coin-roll ejecting device that includes the coin-roll detecting mechanism disclosed in Japanese Patent No. 3456851, because it is the prerequisite that the rolls of coins are stored in the cassette side-by-side with the diameter direction thereof parallel, there is a disadvantage that only a relatively small number of the rolls of coins can be stored in the cassette. Moreover, in the coin-roll detecting mechanism disclosed in Japanese Patent No. 3456851, because two sensors are required to be provided in every cassette, and it is necessary to move each of the sensors along the direction of placement of the rolls of coins in the cassette, there is a disadvantage that the structure to detect the roll of coins in the cassette becomes complicated and then the production cost becomes increased.

The present invention has been made in view of the above discussion. One object of the present invention is to provide a coin-roll ejecting device, a money processing machine, and a coin-roll ejecting method that can determine whether a roll of coins is present in a storing unit even if no sensor to detect a roll of coins is provided in every storing unit allowing the configuration to be made simpler and the production cost to be reduced.

The coin-roll ejecting device of the present invention includes: a storing unit that stores therein a plurality of rolls of coins and having an ejecting mechanism for ejecting the stored rolls of coins one by one; an ejected coin-roll detecting unit that detects a roll of coins ejected from the storing unit by the ejecting mechanism; and a controlling unit that determines whether a roll of coins is present in the storing unit based on a detection result of the roll of coins obtained by the ejected coin-roll detecting unit.

The coin-roll ejecting device of the present invention may further include a lifting unit including a coin-roll storing member for storing therein the roll of coins ejected from the storing unit by the ejecting mechanism, and that is movable in a vertical direction, and the ejected coin-roll detecting unit may be arranged in the coin-roll storing member of the lifting unit.

In the coin-roll ejecting device of the present invention, the ejecting mechanism may include a rotating member having a notch for receiving the roll of coins one by one that is stored in the storing unit, and that rotates around a shaft center that extends horizontally; and a driving unit that rotates the rotating member around the shaft center in an ejection direction of the roll of coins or in a direction opposite to the ejection direction, and the controlling unit may control, when the rotating member is rotated by the driving unit in the ejection direction of the roll of coins and if a predetermined number of the roll of coins is not detected by the ejected coin-roll detecting unit, the ejecting mechanism to perform a retry operation that includes performing once or multiple times a combination of each of an operation to rotate the rotating member in the direction opposite to the ejection direction of the roll of coins and an operation to rotate the rotating member in the ejection direction of the roll of coins, and determines that no roll of coins is stored in the storing unit when the predetermined number of the roll of coins is not detected by the ejected coin-roll detecting unit even after the retry operation has been performed.

In this case, the storing unit may include a bottom surface that is inclined with respect to a horizontal plane, and a plurality of the rolls of coins is stored on the bottom surface in a piled-up manner and along a rolling direction parallel to the inclined bottom surface.

Further, the coin-roll ejecting device of the present invention may further include a gate unit arranged above the rotating member and that prevents a situation where the roll of coins stored in the storing unit does not enter into the notch of the rotating member whereby the roll of coin is ejected from above the rotating member, and the gate unit may move following a rotation motion of the rotating member.

Further, a plurality of retry operations may be set previously in the controlling unit as the retry operation, each of the plurality of retry operations including a combination of the operation to rotate the rotating member in the direction opposite to the ejection direction of the roll of coins having a different duration and/or times and/or the operation to rotate the rotating member in the ejection direction of the roll of coins having a different duration and/or times, and the controlling unit may select one among the retry operations set previously based on whether a predetermined condition is satisfied, the retry operation being performed, if a predetermined number of the roll of coins is not detected by the ejected coin-roll detecting unit when the rotating member is rotated by the driving unit in the ejection direction of the roll of coins.

Further, the storing unit may include a plurality of storing units each storing a roll of coins of a preset denomination, and the predetermined condition may be to eject the roll of coins from the storing units for which the same denomination has been set when the same denomination of the roll of coins is set in the plurality of the storing units.

Further, the controlling unit may determine based on the kind of the performed retry operation that a current state of the storing unit is one of a plurality of confirmed states including a confirmed empty state and a temporary confirmed empty state, upon determining that no roll of coins has been stored in the storing unit.

In this case, the types of the retry operations may be set in the controlling unit as a normal retry operation and a simpler retry operation in which the duration and/or times to rotate the rotating member in the direction opposite to the ejection direction of the roll of coins and/or the duration and/or times to rotate the rotating member in the ejection direction of the roll of coins are shorter/fewer than those in the normal retry operation, and the controlling unit may determine that the current state of the storing unit is the confirmed empty state when the normal retry operation has been performed and determines that the current state of the storing unit is the temporary confirmed empty state when the simpler retry operation has been performed, upon determining that no roll of coins has been stored in the storing unit.

Further, when the same denomination of the roll of coins is set in a plurality of the storing units and when the controlling unit has determined that the current state of at least one of the storing units for which the same denomination of the roll of coins has been set is the confirmed empty state or the temporary confirmed empty state, the controlling unit may control the ejecting mechanism so that when the next roll of coins of the same denomination is ejected from the storing unit, the roll of coins is ejected in a preferential manner from a storing unit other than the storing unit of which the confirmed state has been determined as the confirmed empty state or the temporary confirmed empty state.

Further, when information relating to an inventory amount of the roll of coins stored in the storing unit is updated in the controlling unit, the controlling unit may reset information relating to a determination that the storing unit is in one of the plurality of the confirmed states including the confirmed empty state or the temporary confirmed empty state.

In the coin-roll ejecting device of the present invention, the storing unit may include a plurality of storing units each storing a roll of coins of a preset denomination, and when the same denomination of roll of coins is set in a plurality of the storing units in the controlling unit, the controlling unit may be capable of performing an inventory management of the roll of coins of each of the denominations by inputting a total number of roll of coins of the same denomination stored in the storing units.

In this case, when a roll of coins of a given denomination is to be ejected from the storing unit, the controlling unit may determine whether to eject the roll of coins from that storing unit based on the inventory amount of the roll of coins of the given denomination and based on a determination result relating to whether the roll of coins has been stored in that storing unit.

Further, when a roll of coins of a given denomination is to be ejected from the storing unit, the controlling unit may control the ejecting mechanism to eject the roll of coins from the storing unit corresponding to the given denomination upon determining that the inventory amount of the roll of coins of the given denomination is one or more, and upon determining that no roll of coins has been stored in any of the storing units corresponding to the given denomination.

Further, the coin-roll ejecting device of the present invention may further include a memory unit that stores therein information relating to a determination made by the controlling unit that no roll of coins has been stored in the storing unit, and the information stored in the memory unit relating to the determination that no roll of coins has been stored in the storing unit may be retained therein until a specific instruction is given to the controlling unit.

The money processing machine of the present invention includes the coin-roll ejecting device described above.

The coin-roll ejecting method of the present invention implemented in a coin-roll ejecting device including a storing unit that stores therein a plurality of rolls of coins and having an ejecting mechanism for ejecting the stored rolls of coins one by one, includes: detecting with an ejected coin-roll detecting unit a roll of coins ejected from the storing unit by the ejecting mechanism; and determining whether a roll of coins is present in the storing unit based on a detection result of the roll of coins obtained by the ejected coin-roll detecting unit.

DESCRIPTION OF EMBODIMENT

Figure 1:
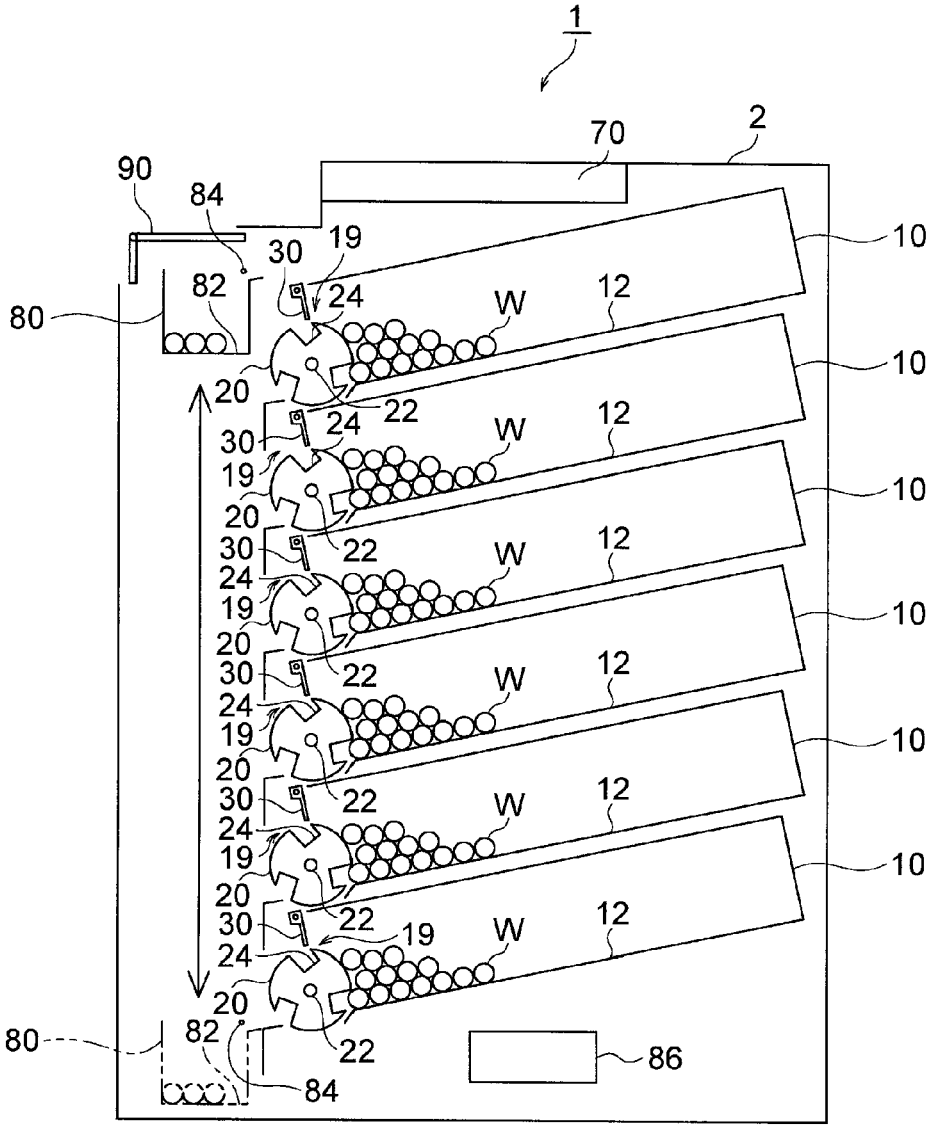
FIG. 1 is a side view of an internal configuration of a coin-roll ejecting device according to an embodiment of the present invention.
Figure 2:
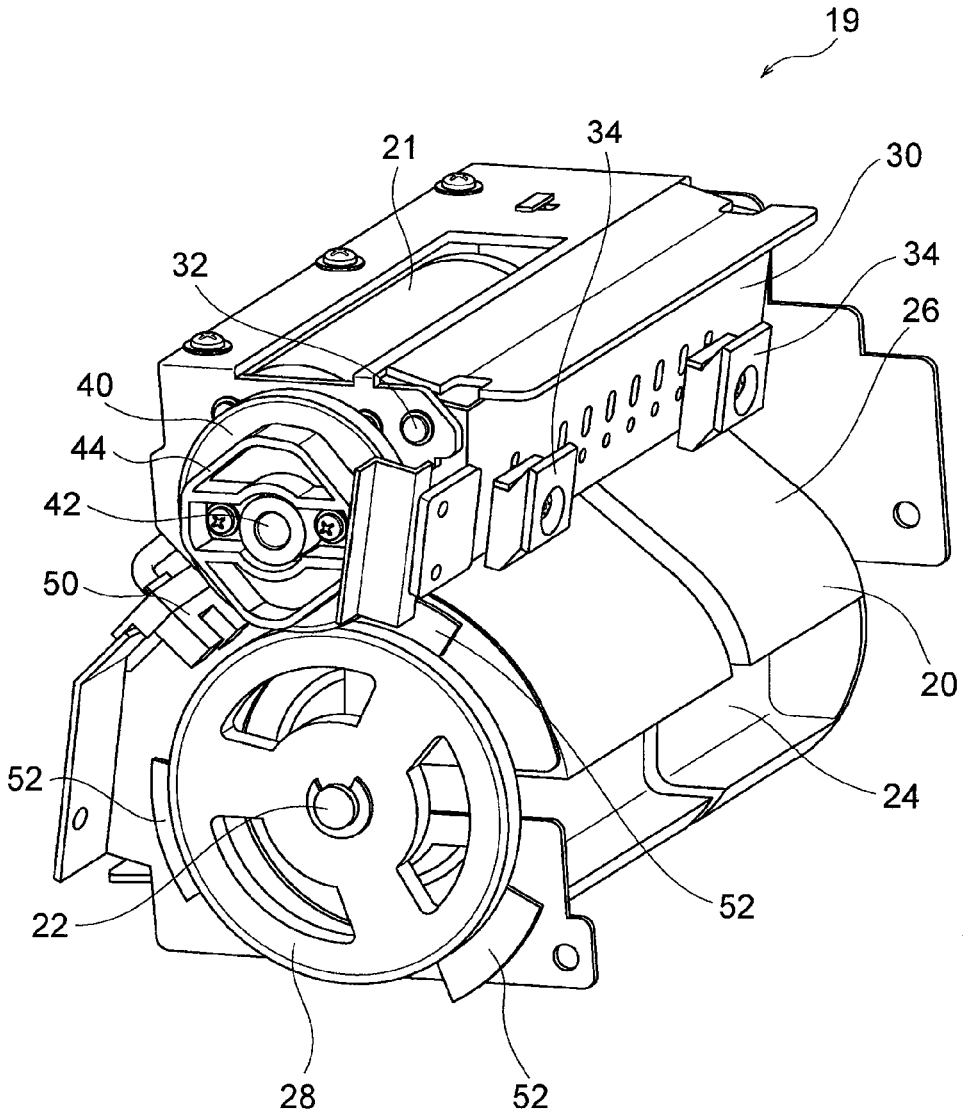
FIG. 2 is a perspective view of a configuration of an ejecting mechanism arranged in each of storing units of the coin-roll ejecting device shown in FIG. 1.
Figure 3:
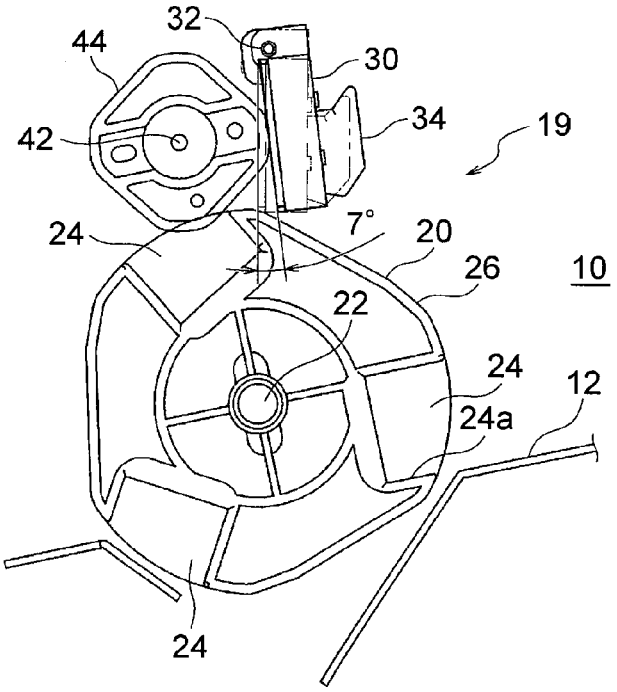
FIG. 3 is a side view of the ejecting mechanism shown in FIG. 2.
Figure 4:
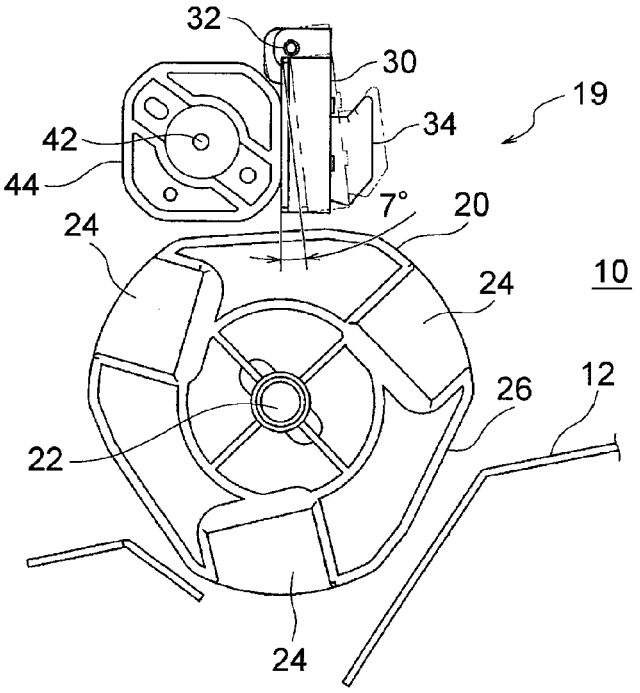
FIG. 4 is another side view of the ejecting mechanism shown in FIG. 2.
Figure 9:
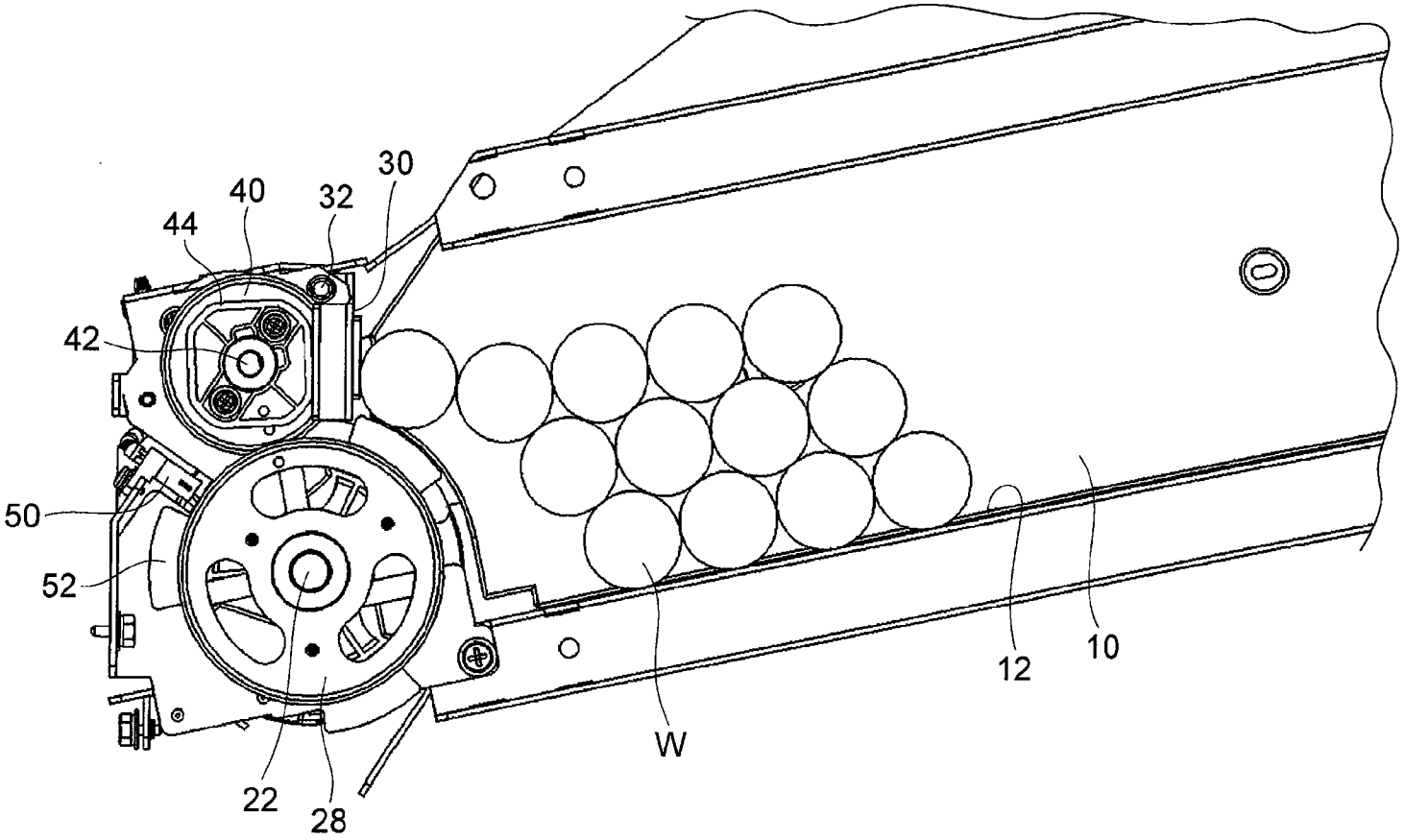
FIG. 9 is a side view depicting a state in which a bridge phenomenon of the rolls of coins has occurred near the ejecting mechanism in the storing unit of the coin-roll ejecting device shown in FIG. 1.
Figure 10:
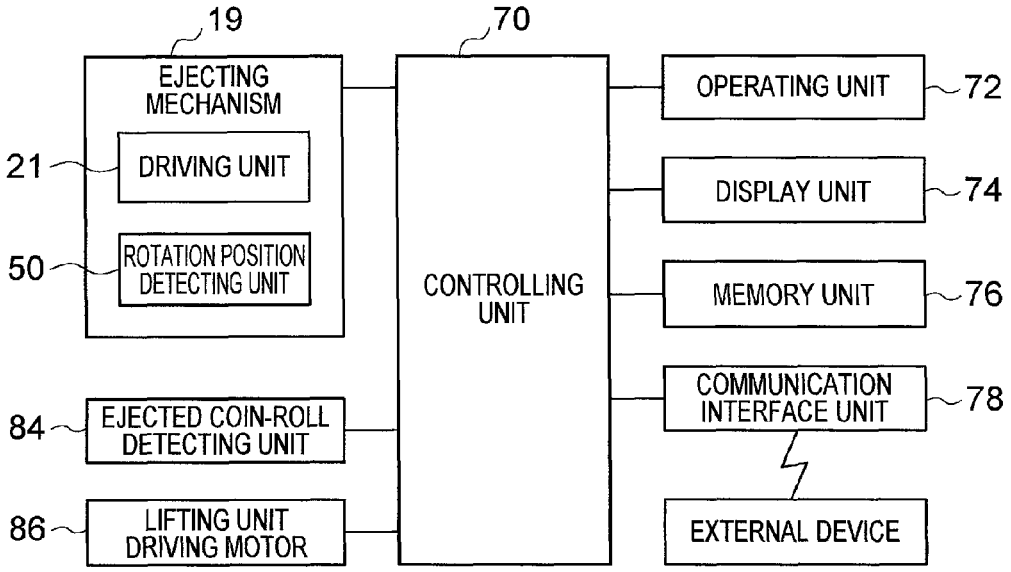
FIG. 10 is a functional block diagram of a configuration of a control system of the coin-roll ejecting device shown in FIG. 1.
Figure 11:
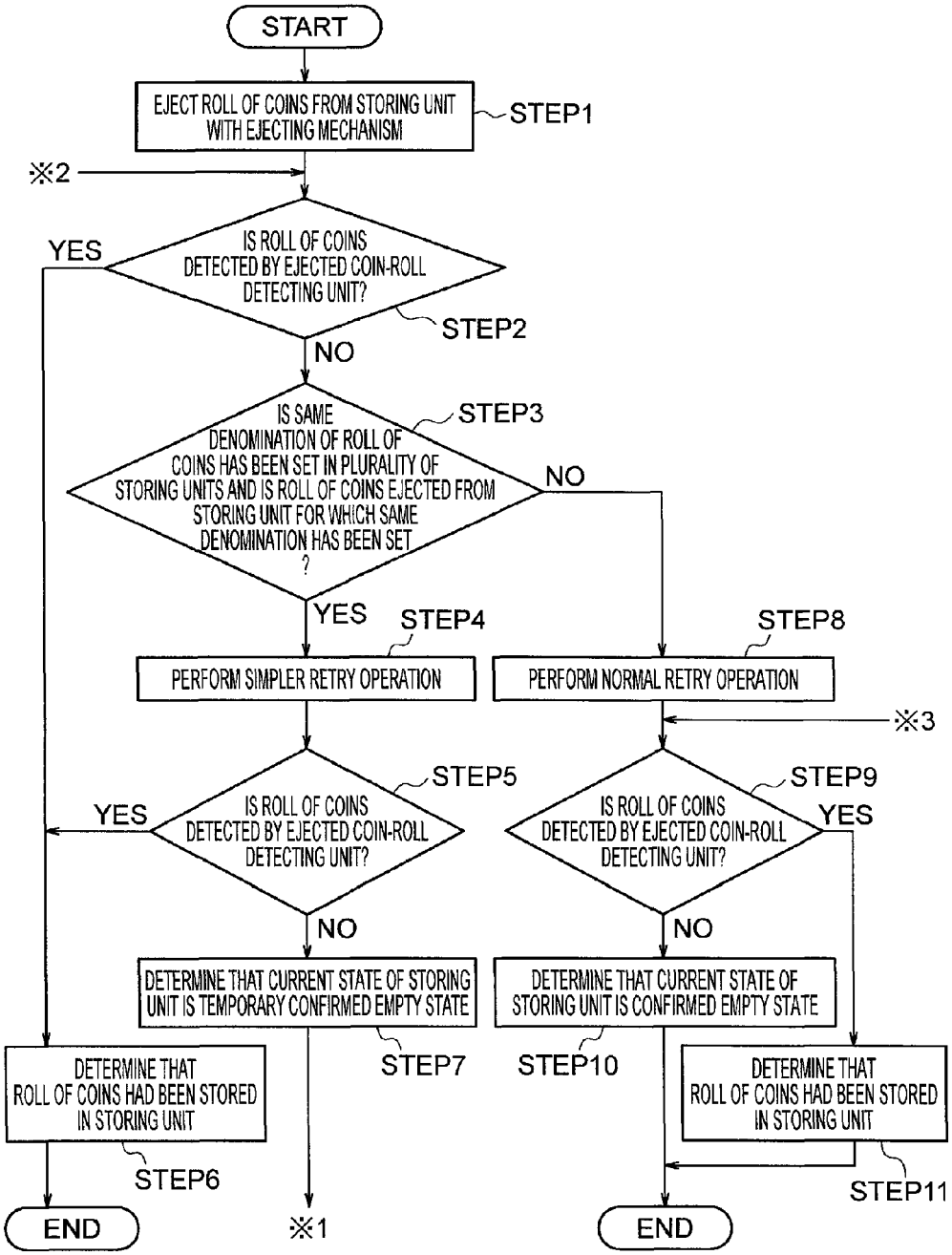
FIG. 11 is a flowchart of operations performed by the coin-roll ejecting device shown in FIG. 1.
Figure 12:
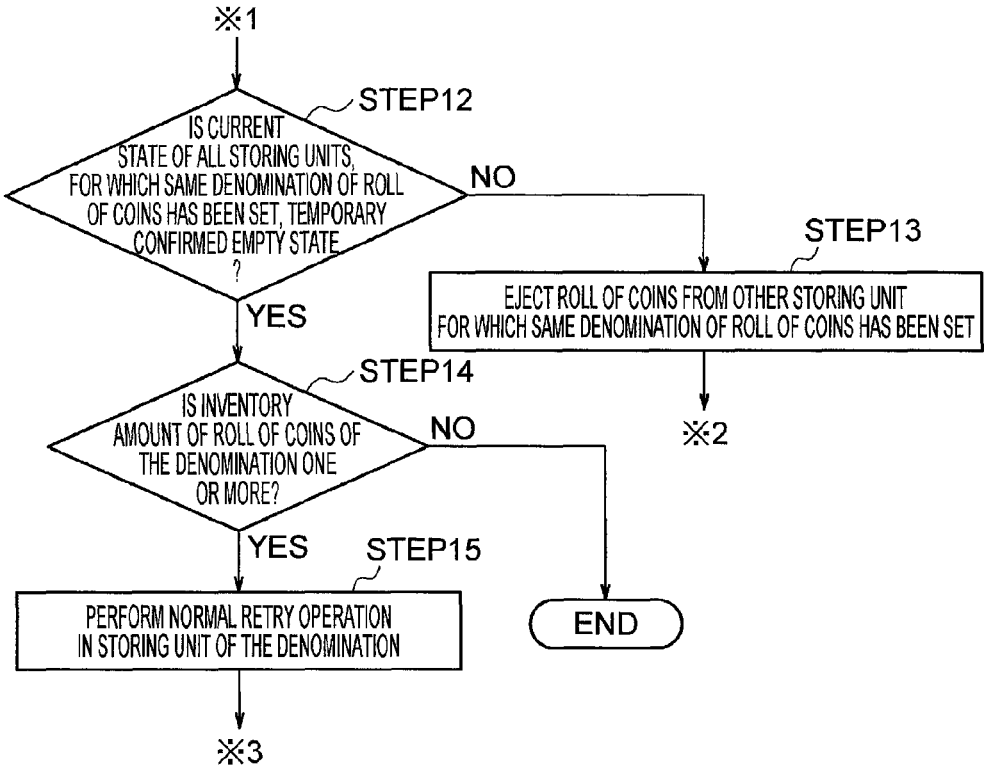
FIG. 12 is a flowchart of the operation performed by the coin-roll ejecting device shown in FIG. 1 and it is a continuation of the flowchart shown in FIG. 11.
Figure 13:
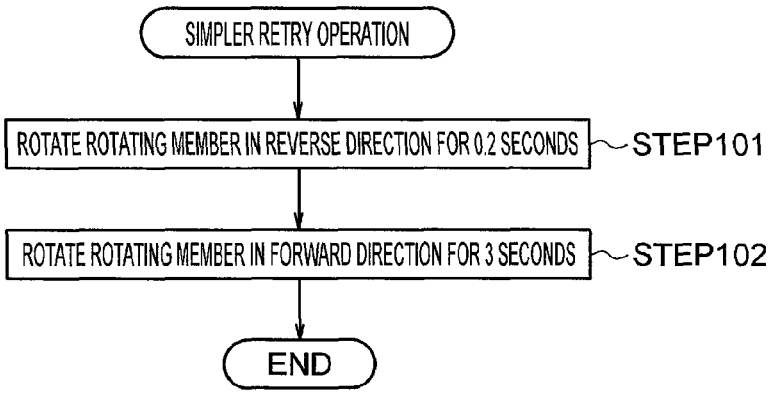
FIG. 13 is a flowchart of a simpler retry operation performed by the coin-roll ejecting device shown in FIG. 1.
Figure 14:
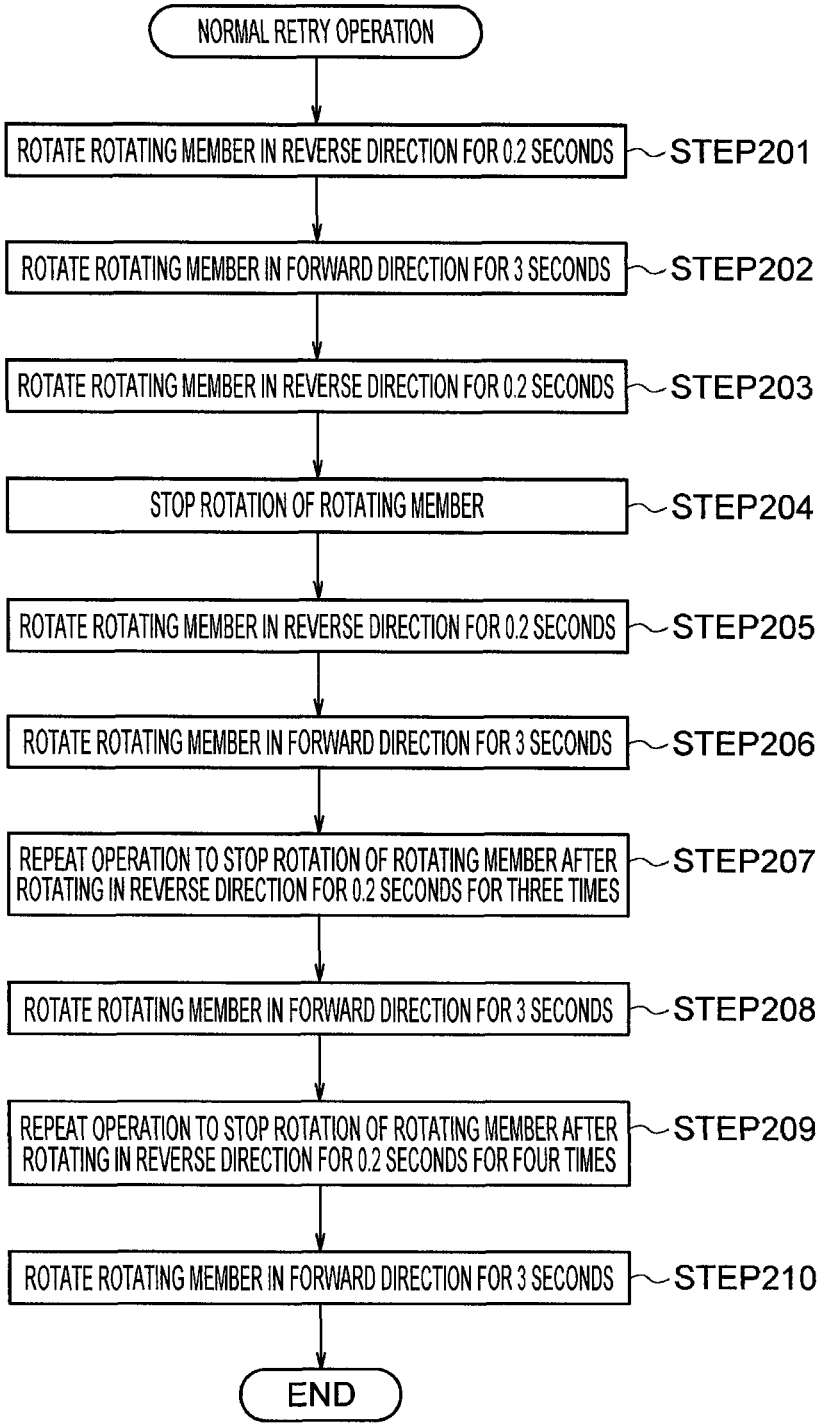
FIG. 14 is a flowchart of a normal retry operation performed by the coin-roll ejecting device shown in FIG. 1.
Figure 15:
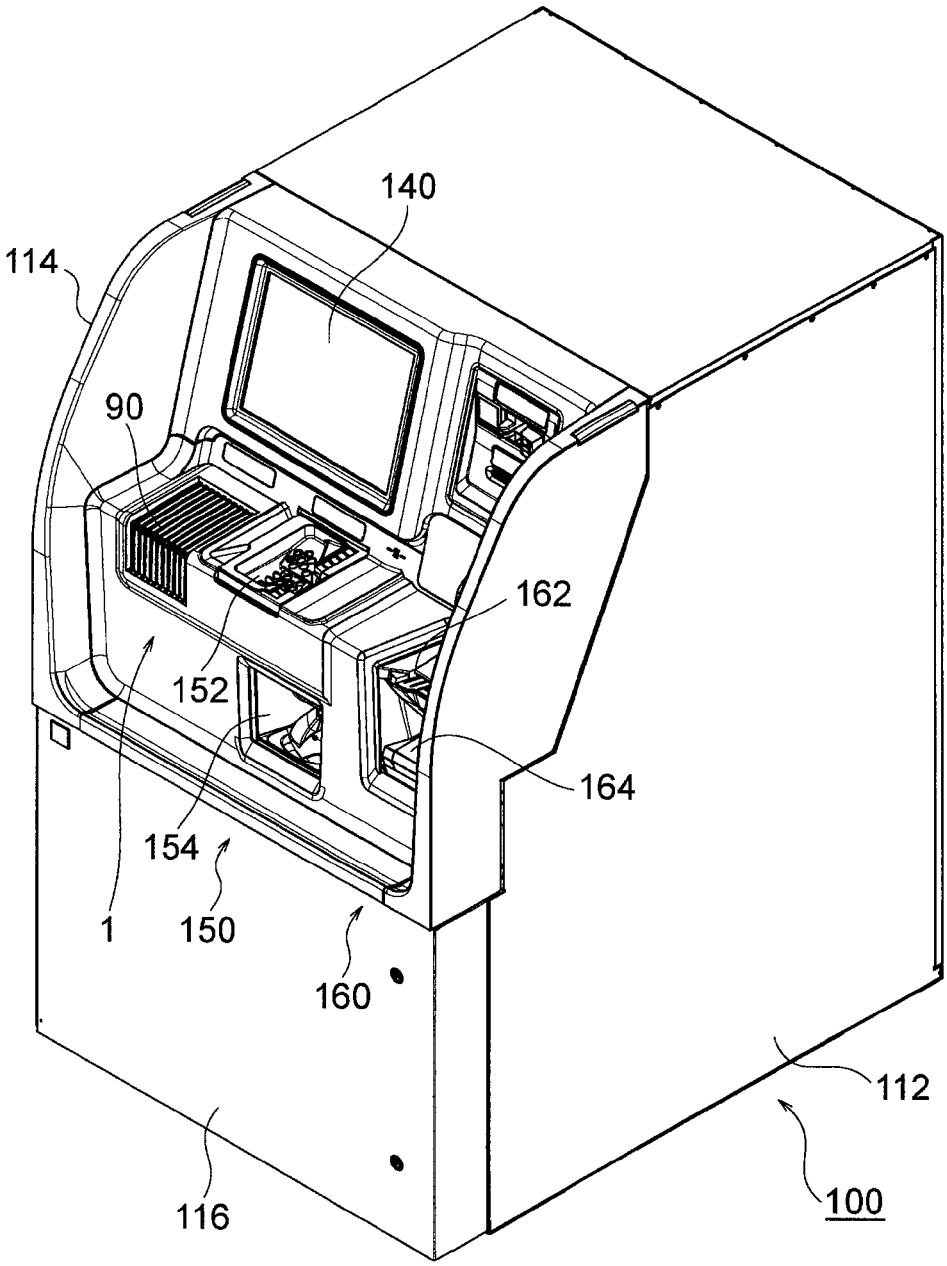
FIG. 15 is a perspective view of a configuration of a money changer that includes the coin-roll ejecting device shown in FIG. 1.

Exemplary embodiments of the present invention are explained below with reference to the accompanying drawings. FIGS. 1 to 15 are views of a coin-roll ejecting device and a money changer that includes the coin-roll ejecting device according to the present embodiment. Among these, FIG. 1 is a side view of an internal configuration of the coin-roll ejecting device according to the present embodiment, FIG. 2 is a perspective view of a configuration of an ejecting mechanism arranged in each of storing units of the coin-roll ejecting device shown in FIG. 1, and FIGS. 3 and 4 are side views of the ejecting mechanism shown in FIG. 2. Moreover, FIGS. 5 to 8 are side views of the coin-roll ejecting device shown in FIG. 1 for explaining an operation performed by the ejecting mechanism when ejecting a roll of coins stored in the storing unit. FIG. 9 is a side view depicting a state in which a bridge phenomenon of the rolls of coins has occurred near the ejecting mechanism in the storing unit of the coin-roll ejecting device shown in FIG. 1. Moreover, FIG. 10 is a functional block diagram of a configuration of a control system of the coin-roll ejecting device shown in FIG. 1, and FIGS. 11 and 12 are flowcharts of operations performed by the coin-roll ejecting device shown in FIG. 1. FIG. 13 is a flowchart of a simpler retry operation and FIG. 14 is a flowchart of a normal retry operation performed by the coin-roll ejecting device shown in FIG. 1. Moreover, FIG. 15 is a perspective view of a configuration of the money changer that includes the coin-roll ejecting device shown in FIG. 1. In FIGS. 1 to 15, a roll of coins processed by the coin-roll ejecting device is shown with a reference letter W. Moreover, for simplification, the roll of coins stored in the storing unit has not been shown in FIGS. 6 to 8, and the like.

As shown in FIG. 1, a coin-roll ejecting device 1 includes a housing 2 having a substantially cuboidal shape, a plurality of (e.g., six) storing units 10 that are arranged inside the housing 2 one above the other in the vertical direction, and a lifting unit 80 capable of moving in the vertical direction. Each of the storing units 10 includes a bottom surface 12 and an ejecting mechanism 19 that ejects the rolls of coins stored in the storing unit one by one from near the bottom surface 12 that is at a lower level with respect to the vertical direction. The lifting unit 80 includes a coin-roll storing member 82 in which a roll of coins ejected by the ejecting mechanism 19 of each of the storing units 10 is stored, and an ejected coin-roll detecting unit 84 that detects a roll of coins ejected by the ejecting mechanism 19 of each of the storing units 10. Moreover, a shutter 90 for opening and closing a coin-roll removal opening is arranged on the top surface of the housing 2. When the lifting unit 80 is at an up position (i.e., when the lifting unit 80 is at a position where it is shown with a continuous line in FIG. 1), the shutter 90 can be opened and the rolls of coins stored in the coin-roll storing member 82 of the lifting unit 80 can be taken out. Moreover, a controlling unit 70 is arranged in an upper part of the coin-roll ejecting device 1. The controlling unit 70 controls the ejecting mechanism 19 of each of the storing units 10 and the lifting unit 80. A detailed explanation of various components of the coin-roll ejecting device 1 is given below.

Figure 5:
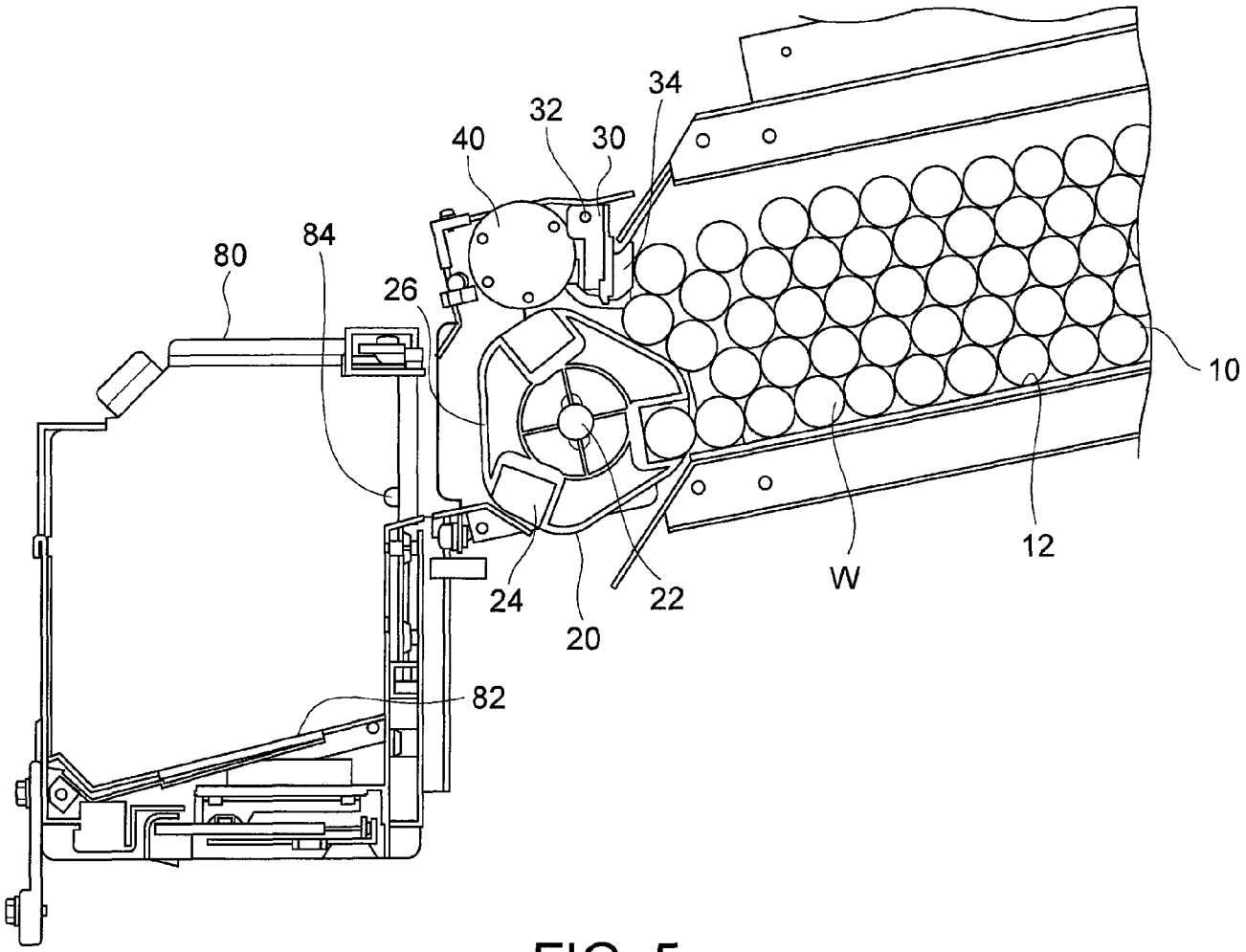
FIG. 5 is a side view of the coin-roll ejecting device shown in FIG. 1 for explaining an operation performed by the ejecting mechanism when ejecting a roll of coins stored in the storing unit.
Figure 6:
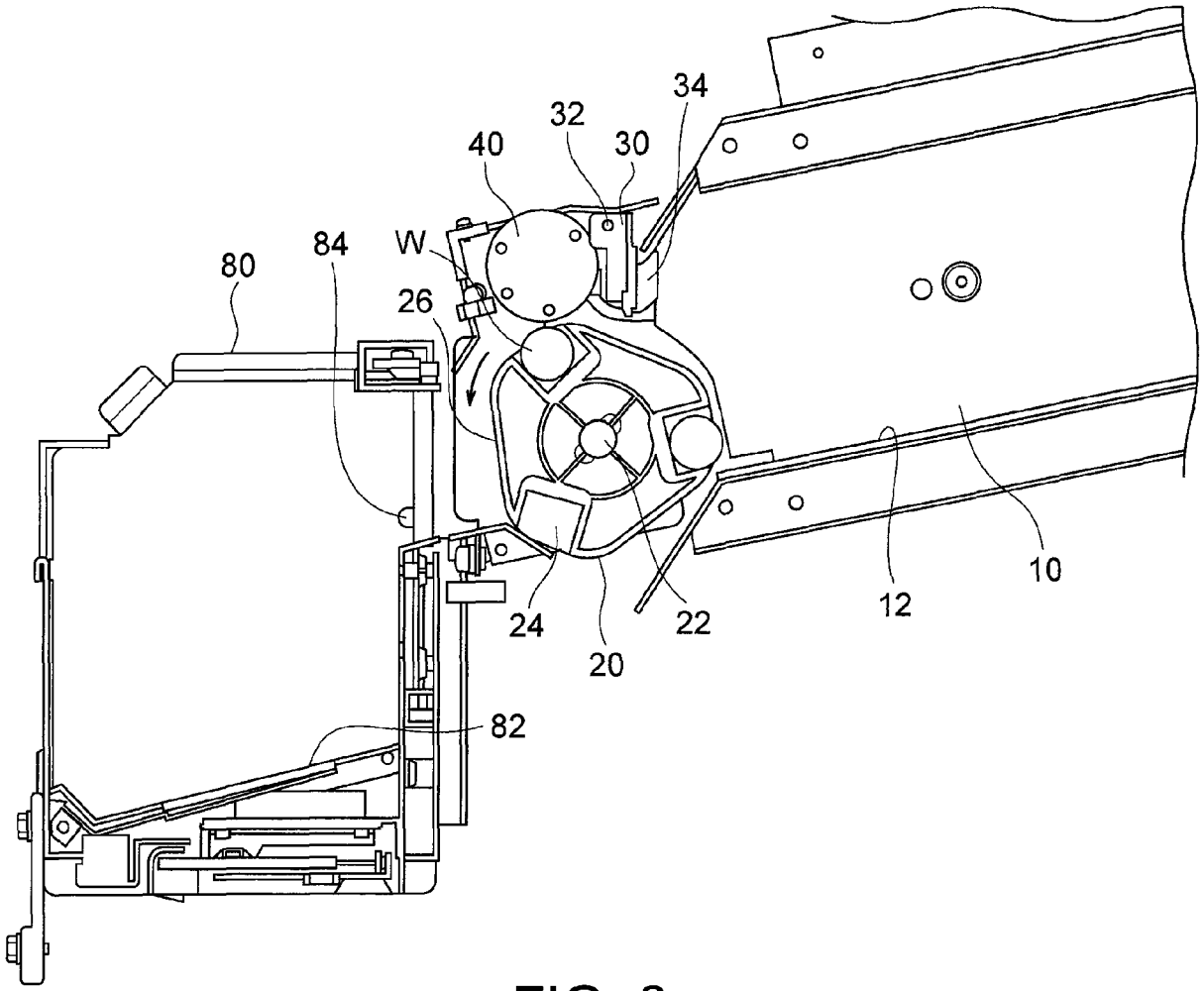
FIG. 6 is another side view of the coin-roll ejecting device shown in FIG. 1 for explaining the operation performed by the ejecting mechanism when ejecting the roll of coins stored in the storing unit.
Figure 7:
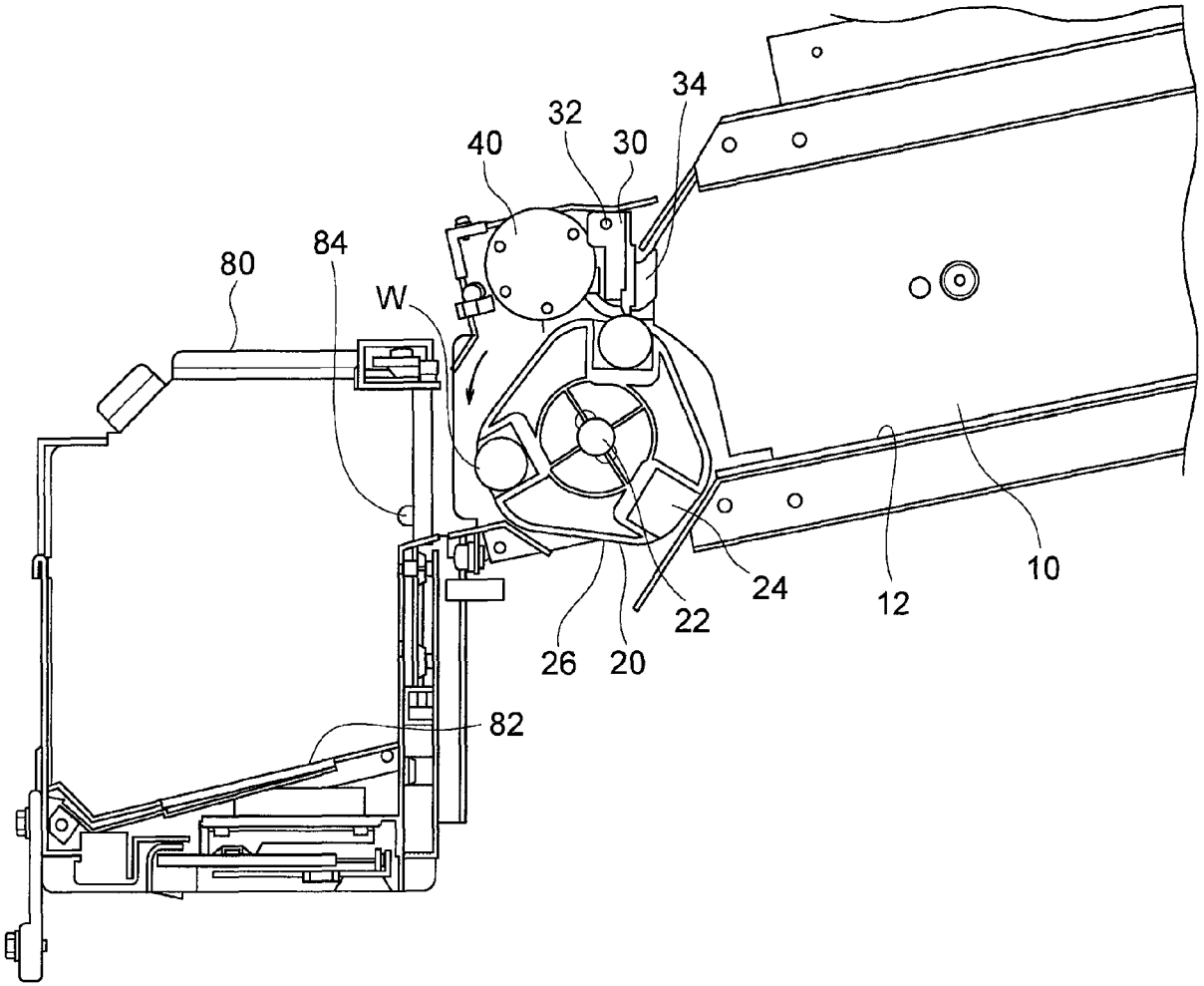
FIG. 7 is still another side view of the coin-roll ejecting device shown in FIG. 1 for explaining the operation performed by the ejecting mechanism when ejecting the roll of coins stored in the storing unit.

As shown in FIGS. 1 and 5, in each of the storing units 10, the rolls of coins are stored on the bottom surface 12 in a piled-up manner and along a rolling direction of the inclined bottom surface 12 with respect to a horizontal plane (i.e., a lower left direction in FIGS. 1 and 5). The term "to store the rolls of coins in a piled-up manner" includes, based on the number of the rolls of coins stored in the storing unit 10, a situation where the rolls of coins are piled-up in several layers on the bottom surface 12, a situation where the rolls of coins are lined-up in one layer (one row) on the bottom surface 12, or a situation where there is only one roll of coins. Moreover, the rolls of coins may be stored in an orderly and properly aligned manner, or the rolls of coins may be stored in a non-orderly manner though their directions may be aligned. That is, what is meant here is that, though the rolls of coins can be piled-up in several layers, it is not necessary that the rolls of coins are piled-up in several layers, and it is not necessary that the rolls of coins are properly aligned.

An angle of inclination of the bottom surface 12 of each of the storing units 10 with respect to the horizontal plane is within a range of 8 degrees to 20 degrees. Moreover, the maximum static friction coefficient of the bottom surface 12 of each of the storing units 10 with respect to the roll of coins is within a range of 0.01 to 0.15. As a result, the rolls of coins those are in contact with the bottom surface 12 among the rolls of coins stored in each of the storing units 10 slide or roll by their weight along the inclined bottom surface 12 toward the ejecting mechanism 19 without being stopped by a frictional force between them and the bottom surface 12.

Each of the storing units 10 includes a pair of side walls that constitutes a storing area for the rolls of coins. At least one of the pair of the side walls constitutes a door that is opened when replenishing the rolls of coins in the storing unit 10 or taking out the rolls of coins from the storing unit 10. The side wall of the storing unit 10 that constitutes the door is made from a transparent member or a semi-transparent member, for example, so that an operator can see inside the storing unit 10 through this side wall. However, instead of making the door with a transparent member or a semi-transparent member, the door can be provided with a slit, a hole, and the like, to allow the operator to see inside the storing unit 10.

As explained above, each of the storing units 10 includes the ejecting mechanism 19 that ejects the rolls of coins one by one from near the bottom surface 12 that is at a lower level with respect to the vertical direction. A configuration of the ejecting mechanism 19 will be explained below by referring to FIGS. 2 to 4. The ejecting mechanism 19 includes a rotating member 20 that rotates around a rotation axis 22 as a shaft center in the counterclockwise direction in FIG. 1. The rotation axis 22 extends horizontally and orthogonally to the direction of inclination of the storing unit 10 (i.e., extends orthogonally to the paper sheet of FIG. 1). Each of the rotating members 20 is provided with at least two notches 24 (three notches are shown in the example shown in FIG. 1 and the like). Every notch 24 receives one by one the roll of coins stored in the storing unit 10. Moreover, the ejecting mechanism 19 includes a driving unit 21 (see FIG. 2) that rotates the rotating member 20 around the rotation axis 22, a rotation position detecting unit 50 that detects a rotating position of the rotating member 20, and a gate unit 30. The gate unit 30 is arranged above the rotating member 20. This gate unit 30 prevents a situation where the roll of coins stored in the storing unit 10 does not enter into the notch 24 of the rotating member 20 whereby the roll of coins is ejected from above the rotating member 20. In each of the ejecting mechanisms 19, the driving unit 21 can rotate the rotating member 20 in both of a forward direction and a reverse direction. The forward direction (i.e., the counterclockwise direction in FIG. 1) is a direction in which the rotating member 20 ejects the roll of coins from the storing unit 10. The reverse direction (i.e., the clockwise direction in FIG. 1) is the reverse of the forward direction. Moreover, the driving unit 21 can change a rotational speed of the rotating member 20.

As shown in FIGS. 3 and 4, the rotating member 20 is provided with the three notches 24 at an equal interval in the direction of rotation of the rotating member 20 around the rotation axis 22. When the rotating member 20 is at a rotation position shown in FIG. 3, one roll of coins among the rolls of coins stored in the storing unit 10 but positioned at the lowest point with respect to the vertical direction on the bottom surface 12 is received in one of the notches 24.

As shown in FIGS. 3 and 4, the rotating member 20 has an outer surface 26 to which the roll of coins stored in the storing unit 10 contacts. The outer surface 26 has a shape such that a distance thereof from the center of the rotation axis 22 changes. Specifically, the rotating member 20 has a substantially polygonal shape (substantially triangular in the example shown in FIGS. 3 and 4) in a side cross-section. The notches 24 are formed near the vertices of the polygon. If a large number of the rolls of coins are stored in the storing unit 10 piled-up in several layers, the rolls of coins stored in the storing unit 10 also contact the outer surface 26 of the rotating member 20. However, based on a storing state of the rolls of coins in the storing unit 10, the rolls of coins cannot move in the storing unit 10, and though the notch 24 of the rotating member 20 is empty, the roll of coins may not enter the notch 24. To address this issue, the distance between the outer surface 26 of the rotating member 20 and the center of the rotation axis 22 is changed. Because this distance is changed, the position of the roll of coins that is in contact with the outer surface 26 when the rotating member 20 is rotated around the rotation axis 22 also changes. Accordingly, because the rolls of coins are stirred and caused to move within the storing unit 10, the roll of coins can be sent in the notch 24 of the rotating member 20.

The notches 24 of the rotating member 20 are formed such that, when one of the notches 24 of the rotating member 20 is positioned at a storing position (i.e., a position shown in FIG. 3), which is a position at which the rotating member 20 is at the rotation position where it is ready to receive the roll of coins from the storing unit 10, an inner wall (shown with a reference number 24*a* in FIG. 3) of this notch 24 and the bottom surface 12 of the storing unit 10 are positioned substantially on one line. With this configuration, when the rotating member 20 is at the rotation position shown in FIG. 3, one roll of coins among the rolls of coins stored in the storing unit 10 but positioned at the lowest point with respect to the vertical direction on the bottom surface 12 is received smoothly in one of the notches 24.

Figure 8:
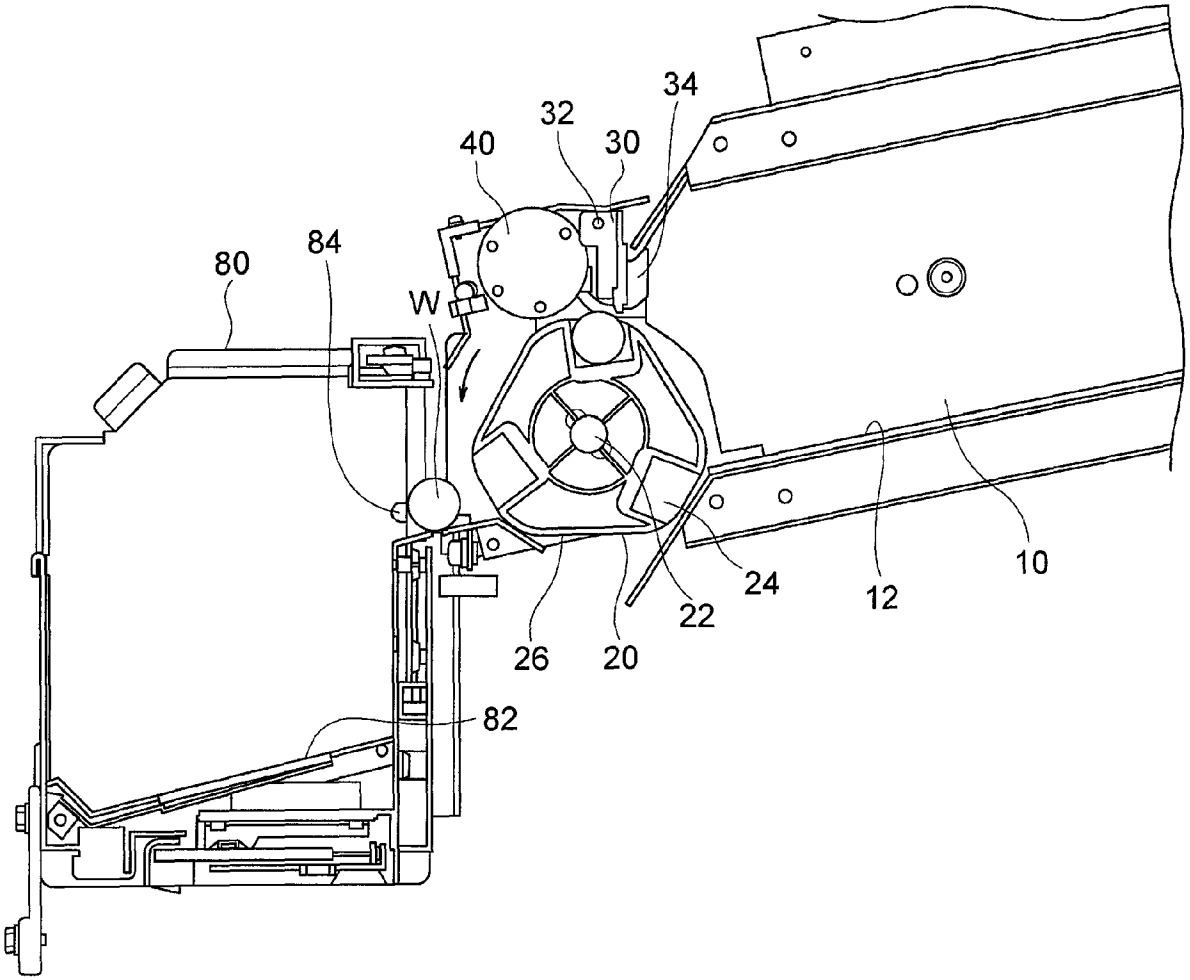
FIG. 8 is still another side view of the coin-roll ejecting device shown in FIG. 1 for explaining the operation performed by the ejecting mechanism when ejecting the roll of coins stored in the storing unit.

As shown in FIG. 8, a shape and a position of each of the notches 24 in the rotating member 20 are set such that, when one notch 24 of the rotating member 20 is positioned at an ejecting position, which is a position at which the rotating member 20 is at the rotation position and ready to eject the roll of coins, other leading notches 24 of this notch 24 are positioned below the bottom surface 12 of the storing unit 10 so that those other leading notches 24 do not receive the rolls of coins from the storing unit 10.

In the present embodiment, a length (a length in a depth direction of the rotating member 20 shown in FIG. 2) in a longitudinal direction of the rotating member 20 along the rotation axis 22 is larger than ½ of the maximum length in a longitudinal direction of the roll of coins that is to be ejected. Accordingly, even if the roll of coins stored in the storing unit 10 is long in the longitudinal direction, the long roll of coins can be ejected surely without losing its balance and stably by the rotating member 20.

As shown in FIG. 2, a gear 28 is provided on the rotation axis 22 on a side of the rotating member 20. This gear 28 rotates in synchronization with the rotating member 20. Moreover, three to-be-detected members 52 are arranged at an equal interval on a circumference of a rotating member that is provided coaxially with and near the gear 28. The rotation position detecting unit 50 that detects each of the to-be-detected members 52 is arranged in a fixed manner near and outside of the gear 28 in a diametrical direction thereof. The rotation position of the rotating member 20 can be detected by the rotation position detecting unit 50 by detecting each of the to-be-detected members 52. More particularly, the rotation position detecting unit 50 is constituted by an optical sensor and the like that includes, for example, a light emitting element and a light receiving element. When the to-be-detected member 52 is positioned between the light emitting element and the light receiving element, the to-be-detected member 52 is detected because an optical axis between the light emitting element and the light receiving element is blocked by this to-be-detected member 52.

The gate unit 30 is arranged above the rotating member 20. This gate unit 30 prevents a situation where the roll of coins stored in the storing unit 10 does not enter into the notch 24 of the rotating member 20 whereby the roll of coins is ejected from above the rotating member 20. That is, as shown in FIG. 1, by blocking a gap between a top surface of the storing unit 10 and the rotating member 20 with the gate unit 30, when a large number of the rolls of coins have been stored in the storing unit 10, it is prevented that the roll of coins is ejected to the lifting unit 80 side from this gap between the top surface of the storing unit 10 and the rotating member 20.

As shown in FIGS. 3 and 4, a swing shaft 32 as a shaft that extends horizontally is provided on upper part of the gate unit 30, and the gate unit 30 is swingable around the swing shaft 32. A mechanism to swing the gate unit 30 is explained below. As shown in FIG. 2, a gear 40 that engages with the gear 28 is arranged above the gear 28. The gear 40 is rotated around a rotation axis 42 by the driving unit 21. Because teeth provided on a circumference of the gear 28 are engaged with teeth provided on a circumference of the gear 40, the gear 28 rotates following the rotation of the gear 40. Thus, the rotating member 20 is rotated via the gears 40 and 28 by the driving unit 21. Moreover, a cam 44 is arranged on a side of the gear 40. The cam 44 rotates around the rotation axis 42 in synchronization with the gear 40. As shown in FIGS. 2 to 4, the cam 44 has a substantially quadrangular shape in a cross section. When the cam 44 is rotated around the rotation axis 42, each vertex of the cam 44 intermittently pushes a side of the gate unit 30 from the left side in FIGS. 3 and 4 to move the gate unit 30. As a result, the gate unit 30 swings around the swing shaft 32 between a position at which the gate unit 30 is shown with a continuous line and a position at which the gate unit 30 is shown with a two-dot chain line in FIGS. 3 and 4. For simplification, the shape of the teeth of the gears 28 and 40 has been omitted from the drawings.

Based on the storing state of the rolls of coins in the storing unit 10, when the roll of coins stored in the storing unit 10 is in contact with the gate unit 30, assuming that the position of the gate unit 30 is fixed, this roll of coins that is in contact with the gate unit 30, or other rolls of coins in the storing unit 10, may not move smoothly in the storing unit 10. For example, if the rolls of coins in the storing unit 10 are in a state shown in FIG. 9, i.e., when a plurality of (four in the example shown in FIG. 9) the rolls of coins form a bridge between the bottom surface 12 of the storing unit 10 and the gate unit 30, these rolls of coins do not move inside the storing unit 10. Accordingly, though the rolls of coins have been stored in the storing unit 10, the roll of coins cannot be sent in the notch 24 of the rotating member 20. In contrast, in the present embodiment, the gate unit 30 swings around the swing shaft 32 that extends horizontally following the rotation motion of the rotating member 20. Therefore, if the roll of coins stored in the storing unit 10 is in contact with the gate unit 30, this roll of coins is pushed and moved by the gate unit 30. Accordingly, because even the positions of the rolls of coins in the storing unit 10 are shifted and the rolls of coins are stirred and moved within the storing unit 10, the roll of coins can be sent in the notch 24 of the rotating member 20. As shown in FIGS. 3 and 4, a swing angle of the gate unit 30 around the swing shaft 32 is, for example, 7 degrees.

However, based on the storing state of the rolls of coins in the storing unit 10, when the roll of coins stored in the storing unit 10 is in contact with the gate unit 30, the roll of coins that is pushed and moved by the gate unit 30, or the other rolls of coins in the storing unit 10, may not move smoothly inside the storing unit 10 even if the gate unit 30 is swung. The factors that often govern the occurrence of this phenomenon are a distance between the bottom surface 12 of the storing unit 10 and a side surface of the gate unit 30 where the roll of coins contacts the gate unit 30, a diameter of the rolls of coins, and the like. To address this issue, one or more mounting members 34 are detachably mounted on the side surface of the gate unit 30 where the roll of coins contacts the gate unit 30. These mounting members 34 are arranged such that they can contact the roll of coins stored in the storing unit 10. The mounting members 34 allow changing the distance between the bottom surface 12 of the storing unit 10 and the side surface of the gate unit 30 where the roll of coins contacts the gate unit 30. More particularly, as shown in FIG. 2, a plurality of mounting holes are formed in the side surface of the gate unit 30 where the roll of coins contacts the gate unit 30 and along the direction in which the rotation axis 22 of the rotating member 20 extends. At least one mounting member 34 can be mounted in one of the mounting holes.

An operation performed by the ejecting mechanism 19, having the above-explained configuration, when ejecting a roll of coins stored in the storing unit 10 is explained below by referring to FIGS. 5 to 8. When, as shown in FIG. 5, one of the notches 24 of the rotating member 20 is positioned at a storing position, which is a position at which the rotating member 20 is at the rotation position and ready to receive the roll of coins from the storing unit 10, one roll of coins among the rolls of coins stored in the storing unit 10 but positioned at the lowest point with respect to the vertical direction on the bottom surface 12 is received smoothly in this notch 24. In this state, as shown in FIG. 5, when the rotating member 20 is rotated by the driving unit 21 in the counterclockwise direction in FIG. 5 from the rotation position of the rotating member 20, the rotating member 20 rotates to an ejecting position shown in FIG. 8 after passing through positions shown in FIGS. 6 and 7. When the rotating member 20 is in this ejecting position, the roll of coins is ejected from the notch 24 of the rotating member 20 to be sent to the coin-roll storing member 82 of the lifting unit 80.

In the present embodiment, the roll of coins of which denomination should be stored in which storing unit 10 is set previously. When making this setting, it is possible to set such that the rolls of coins of the same denomination are stored in a plurality of the storing units 10. Moreover, in the controlling unit 70 of the coin-roll ejecting device 1 explained below, when the setting is made so that the rolls of coins of the same denomination are to be stored in the plurality of the storing units 10, by inputting the total number of the rolls of coins of the same denomination that have been stored in the plurality of the storing units 10 by using a later-explained operating unit 72 and the like, it is possible to perform an inventory management of the rolls of coins of each of the denominations. That is, for example, when rolls of coins of JPY 100 are set as a denomination of the rolls of coins to be stored in three of the storing units 10, in performing the inventory management of the rolls of coins stored in each of the storing units 10 of the coin-roll ejecting device 1, the controlling unit 70, rather than separately managing the numbers of rolls of coins of JPY 100 stored in these three storing units 10, manages the total number of rolls of coins of JPY 100 stored in all three storing units 10 together. Moreover, when replenishing the rolls of coins of JPY 100 in these three storing units 10, the operator inputs, by using the later-explained operating unit 72, the total number of the rolls of coins of JPY 100 stored in each of these storing units 10.

The lifting unit 80 is movable up and down, as shown with an arrow in FIG. 1, between a position at which the lifting unit 80 faces the ejecting mechanism 19 of each of the storing units 10 and an upper position near the shutter 90. Specifically, a lifting unit driving motor 86 that causes the lifting unit 80 to move up and down is arranged inside the housing 2 of the coin-roll ejecting device 1. That is, the lifting unit 80 is driven by the lifting unit driving motor 86. When the roll of coins stored in a given storing unit 10 is to be ejected by the ejecting mechanism 19 of the given storing unit 10, the lifting unit 80 is moved to the position facing this ejecting mechanism 19. As explained above, the lifting unit 80 includes the coin-roll storing member 82 in which the roll of coins ejected by the ejecting mechanism 19 of each of the storing units 10 is stored, and the ejected coin-roll detecting unit 84 that detects the roll of coins ejected by the ejecting mechanism 19 of each of the storing units 10. When the roll of coins stored in the storing unit 10 is ejected by the ejecting mechanism 19, this roll of coins is detected by the ejected coin-roll detecting unit 84 and then stored in the coin-roll storing member 82. The ejected coin-roll detecting unit 84 includes an optical sensor and the like that includes, for example, a light emitting element and a light receiving element. When the roll of coins ejected by the ejecting mechanism 19 is sent to the lifting unit 80, this roll of coins is detected because an optic axis between the light emitting element and the light receiving element is blocked by the roll of coins.

A configuration of a control system of the coin-roll ejecting device 1 having the above-explained configuration is explained below by using FIG. 10. As shown in FIG. 10, the coin-roll ejecting device 1 according to the present embodiment includes the controlling unit 70. The ejecting mechanism 19 (specifically, the driving unit 21 and the rotation position detecting unit 50), the ejected coin-roll detecting unit 84, and the lifting unit driving motor 86 are connected to the controlling unit 70 in a communicable manner. Detection information obtained in each of the rotation position detecting unit 50 and the ejected coin-roll detecting unit 84 are sent to the controlling unit 70. The controlling unit 70 sends a command signal to the driving unit 21 and the lifting unit driving motor 86 to control these structural components.

Moreover, as shown in FIG. 10, the operating unit 72, a display unit 74, a memory unit 76, and a communication interface unit 78 are connected to the controlling unit 70 in a communicable manner. The operating unit 72 is constituted by, for example, a keyboard that is arranged on a front surface or a top surface of the housing 2. The operator can input various pieces of information and commands into the controlling unit 70 by using the operating unit 72. Moreover, the display unit 74 is constituted by, for example, a monitor that is arranged on the front surface or the top surface of the housing 2. The information and the like relating to the inventory amount of each of the denominations of the roll of coins stored in each of the storing units 10 and the processing contents of the roll of coins in the coin-roll ejecting device 1 is displayed on the display unit 74. In the coin-roll ejecting device 1 according to the present embodiment, instead of providing the operating unit 72 and the display unit 74 separately, for example, an operation and displaying unit such as a touch panel in which the operating unit 72 and the display unit 74 are integrated can be used. The information and the like relating to the inventory amount of each of the denominations of the roll of coins stored in each of the storing units 10 and the processing contents of the roll of coins in the coin-roll ejecting device 1 is stored in the memory unit 76. Moreover, the controlling unit 70 can transmit/receive signals via the communication interface unit 78 to/from an external device (for example, specifically, a host device) arranged separately from the coin-roll ejecting device 1.

The coin-roll ejecting device 1 according to the present embodiment can be used singly. Alternatively, the coin-roll ejecting device 1 according to the present embodiment can be integrated with a loose-coin depositing and dispensing device and a loose-banknote depositing and dispensing device to constitute a money changer (a money processing machine). FIG. 15 is a perspective view of a configuration of a money changer 100 as the money processing machine that includes the coin-roll ejecting device 1 according to the present embodiment. As shown in FIG. 15, the money changer 100 that includes the coin-roll ejecting device 1 according to the present embodiment has an outer housing 112 with a substantially cuboidal shape. Inside the outer housing 112, the coin-roll ejecting device 1 according to the present embodiment, a loose-coin depositing and dispensing device 150, and a loose-banknote depositing and dispensing device 160 are arranged side-by-side in a lateral direction. An upper door 114 and a lower door 116 are arranged on a front surface of the outer housing 112 of the money changer 100. The upper door 114 can be opened upward from its closed state shown in FIG. 15. The lower door 116 can be opened laterally from its closed state shown in FIG. 15. By opening the upper door 114 and the lower door 116, the coin-roll ejecting device 1, the loose-coin depositing and dispensing device 150, and the loose-banknote depositing and dispensing device 160, that are housed inside the outer housing 112 can be separately pulled horizontally and away from the outer housing 112 to remove them from the inside of the outer housing 112. In FIG. 15, a reference number 152 represents a coin depositing opening used when depositing a loose coin inside a body of the loose-coin depositing and dispensing device 150, and a reference number 154 represents a coin ejection opening for ejecting a loose coin outside the body of the loose-coin depositing and dispensing device 150. Moreover, a reference number 162 represents a banknote depositing opening used when depositing a banknote inside a body of the loose-banknote depositing and dispensing device 160, and a reference number 164 represents a banknote ejection opening for ejecting a banknote outside the body of the loose-banknote depositing and dispensing device 160.

Moreover, as shown in FIG. 15, an operation and displaying unit 140 constituted by, for example, a touch panel and the like, is arranged in the upper door 114 of the money changer 100. The operation and displaying unit 140 displays information relating to a processing state, an inventory amount, and the like of the money in each of the devices 1, 150, and 160. Moreover, the operator can input various commands into each of the devices 1, 150, and 160 by operating the operation and displaying unit 140.

An operation performed by the coin-roll ejecting device 1 having the above-explained configuration is explained below. The operation performed by the coin-roll ejecting device 1 explained below is realized by the controlling unit 70 by controlling each of the structural components of the coin-roll ejecting device 1.

When ejecting a roll of coins from a given storing unit 10 of the coin-roll ejecting device 1 according to the present embodiment, the lifting unit 80 is moved at a position facing the ejecting mechanism 19 of this storing unit 10. Then, the rotating member 20 of this ejecting mechanism 19 is rotated in the ejection direction (specifically, the counterclockwise direction in FIG. 1) whereby a roll of coins that had been accommodated in the notch 24 of this rotating member 20 is sent to the coin-roll storing member 82 of the lifting unit 80. In this process, the roll of coins ejected from the storing unit 10 by the ejecting mechanism 19 is detected by the ejected coin-roll detecting unit 84 of the lifting unit 80. Moreover, the controlling unit 70 determines whether the roll of coins is present in the storing unit 10 based on the detection result of the roll of coins obtained by the ejected coin-roll detecting unit 84. Specifically, the controlling unit 70 determines, when rotating the rotating member 20 in the ejection direction of the roll of coins by the driving unit 21 of the ejecting mechanism 19 to cause a predetermined number of the roll of coins to be ejected from the storing unit 10, whether the predetermined number of the roll of coins is detected by the ejected coin-roll detecting unit 84. The controlling unit 70 controls, when the predetermined number of the roll of coins is not detected, the driving unit 21 of the ejecting mechanism 19 to perform a retry operation that includes performing once or multiple times a combination of each of an operation to rotate the rotating member 20 in the direction opposite to the ejection direction of the roll of coins and an operation to rotate the rotating member 20 in the ejection direction of the roll of coins. The controlling unit 70 determines that no roll of coins has been stored in the storing unit 10 when no roll of coins is detected by the ejected coin-roll detecting unit 84 even when the retry operation has been performed.

More particularly, when the ejecting mechanism 19 performs an ejection operation of the roll of coins from the storing unit 10, sometimes the rolls of coins are stored in the storing unit 10 in the manner shown in FIG. 9. That is, a plurality of the rolls of coins is involved in a so-called bridge phenomenon between the bottom surface 12 of the storing unit 10 and the gate unit 30. When this happens, the rolls of coins cannot move within the storing unit 10. That is, though the rolls of coins have been stored in the storing unit 10, no roll of coins is sent in the notch 24 of the rotating member 20. In this situation, no roll of coins is detected by the ejected coin-roll detecting unit 84 because no roll of coins is ejected from the storing unit 10 by the ejecting mechanism 19. However, if it is determined that no roll of coins has been stored in the storing unit 10 only because no roll of coins is detected by the ejected coin-roll detecting unit 84, a wrong detection of the presence/absence of the roll of coins in the storing unit 10 occurs because it is determined that no roll of coins has been stored in the storing unit 10 though in reality the rolls of coins have been stored in the storing unit 10 as shown in FIG. 9. Therefore, in the present embodiment, if the predetermined number of the roll of coins is not detected by the ejected coin-roll detecting unit 84 when the rotating member 20 is rotated by the driving unit 21 of the ejecting mechanism 19 in the ejection direction of the roll of coins, the retry operation of rotating the rotating member 20 in the reverse direction and the forward direction is performed. Moreover, the gate unit 30 is swung following the rotation motion of the rotating member 20. Accordingly, the rolls of coins that are involved in the bridge phenomenon in the storing unit 10 are stirred and caused to move within the storing unit 10 by being pushed and shifted by the gate unit 30. In this manner, even if the rolls of coins are involved in the bridge phenomenon in the storing unit 10 as shown in FIG. 9, the rolls of coins that are involved in the bridge phenomenon can be relieved by performing the retry operation. Accordingly, because there is a high possibility that the roll of coins is sent in the notch 24 of the rotating member 20, the roll of coins can be ejected from the storing unit 10 by the ejecting mechanism 19. In this manner, in the present embodiment, the controlling unit 70 determines that no roll of coins has been stored in the storing unit 10 only when no roll of coins is detected by the ejected coin-roll detecting unit 84 even after performing the retry operation.

In the controlling unit 70, a plurality of retry operations is set previously as the retry operation. Each of the plurality of retry operations includes a combination of the operation to rotate the rotating member 20 in the direction opposite to the ejection direction of the roll of coins having a different duration and/or times and/or the operation to rotate the rotating member 20 in the ejection direction of the roll of coins having a different duration and/or times. Specifically, as the retry operation, in the controlling unit 70 are set a simpler retry operation and a normal retry operation. In the simpler retry operation, the duration and/or times to rotate the rotating member 20 in the direction opposite to the ejection direction of the roll of coins and the duration and/or times to rotate the rotating member 20 in the ejection direction of the roll of coins are shorter/fewer. In contrast, in the normal retry operation, the duration and/or times to rotate the rotating member 20 in the direction opposite to the ejection direction of the roll of coins and the duration and/or times to rotate the rotating member 20 in the ejection direction of the roll of coins are longer/more than those in the simpler retry operation. The simpler retry operation and the normal retry operation are explained by using flowcharts shown in FIGS. 13 and 14.

As shown in FIG. 13, in the simpler retry operation, after rotating the rotating member 20 in the reverse direction (clockwise direction in FIG. 1) for 0.2 seconds (STEP101), the rotating member 20 is rotated in the forward direction (counterclockwise direction in FIG. 1) for 3 seconds (STEP102). In the simpler retry operation, when the predetermined number of the roll of coins is not detected by the ejected coin-roll detecting unit 84, by performing the simpler retry operation, it can be determined in about 3.2 seconds whether a roll of coins has been stored in the storing unit 10.

On the other hand, as shown in FIG. 14, in the normal retry operation, at first, after rotating the rotating member 20 in the reverse direction (clockwise direction in FIG. 1) for 0.2 seconds (STEP201), the rotating member 20 is rotated in the forward direction (counterclockwise direction in FIG. 1) for 3 seconds (STEP202). Then, after rotating the rotating member 20 again in the reverse direction for 0.2 seconds (STEP203), the rotation of the rotating member 20 is temporarily stopped (STEP204). Subsequently, after rotating the rotating member 20 again in the reverse direction for 0.2 seconds (STEP205), the rotating member 20 is rotated in the forward direction for 3 seconds (STEP206). Then, an operation to stop the rotation of the rotating member 20 after rotating the rotating member 20 in the reverse direction for 0.2 seconds is repeated three times (STEP207), and then the rotating member 20 is rotated in the forward direction for 3 seconds (STEP208). Then, an operation to stop the rotation of the rotating member 20 after rotating the rotating member 20 in the reverse direction for 0.2 seconds is repeated four times (STEP209), and then the rotating member 20 is rotated in the forward direction for 3 seconds (STEP210). In the normal retry operation, the duration and/or times to rotate the rotating member 20 in the direction opposite to the ejection direction of the roll of coins and the duration and/or times to rotate the rotating member 20 in the ejection direction of the roll of coins are longer/more than those in the simpler retry operation. Therefore, when the predetermined number of the roll of coins is not detected by the ejected coin-roll detecting unit 84, by performing the normal retry operation, it can be determined in about 30 seconds whether a roll of coins has been stored in the storing unit 10. Though more time is required to determine whether a roll of coins has been stored in the storing unit 10 in comparison with the simpler retry operation, because the duration and/or times to rotate the rotating member 20 in the forward direction and the reverse direction are longer/more, it can be determined more surely whether a roll of coins has been stored in the storing unit 10.

In the present embodiment, the controlling unit 70 determines, upon determining that no roll of coins has been stored in the storing unit 10, based on the performed retry operation, that a current state of the storing unit 10 is one of a plurality of confirmed states including a confirmed empty state and a temporary confirmed empty state. Specifically, the controlling unit 70 determines, upon determining that no roll of coins has been stored in the storing unit 10, that the current state of the storing unit 10 is the confirmed empty state when the normal retry operation has been performed, and that the current state of the storing unit 10 is the temporary confirmed empty state when the simpler retry operation has been performed. The information relating to a determination that the storing unit 10 is one of the plurality of the confirmed states including the confirmed empty state and the temporary confirmed empty state is stored in the memory unit 76. When an operator replenishes the rolls of coins in each of the storing units 10 of the coin-roll ejecting device 1 and inputs information relating to a replenished number of the rolls of coins by using the operating unit 72 (or the operation and displaying unit 140 of the money changer 100), the controlling unit 70 updates the information relating to the inventory amount of the roll of coins stored in the storing unit 10. When this information is updated, the information relating to the determination that the storing unit 10 is in one of the plurality of the confirmed states including the confirmed empty state and the temporary confirmed empty state is reset. In the present embodiment, the information relating to the determination that the storing unit 10 is in one of the plurality of the confirmed states including the confirmed empty state and the temporary confirmed empty state is retained in the memory unit 76 until a specific instruction is given to the controlling unit 70 irrespective of whether a power of the coin-roll ejecting device 1 is turned off, a door to access each of the storing units 10 of the coin-roll ejecting device 1 is opened/closed, an entire unit of the storing units 10 is drawn out, and the like. That is, even if the power of the coin-roll ejecting device 1 is turned off and the like, the information retained in the memory unit 76 relating to the determination that the storing unit 10 is in one of the plurality of the confirmed states including the confirmed empty state and the temporary confirmed empty state is not reset. This information is retained in the memory unit 76 until the specific instruction is given to the controlling unit 70 (specifically, until the information relating to the inventory amount of the roll of coins stored in the storing unit 10 is updated).

Moreover, in the present embodiment, the controlling unit 70 selects, if the predetermined number of the roll of coins is not detected by the ejected coin-roll detecting unit 84 when the rotating member 20 is rotated by the driving unit 21 of the ejecting mechanism 19 in the ejection direction of the roll of coins, the retry operation to be performed among the plurality of the retry operations set previously (specifically, the simpler retry operation and the normal retry operation) based on whether the predetermined condition is satisfied. The "predetermined condition" is that, when the same denomination of the roll of coins is set in a plurality of the storing units 10, and ejecting the roll of coins from the storing unit 10 for which the same denomination has been set. When such a "predetermined condition" is satisfied, the controlling unit 70 performs the simpler retry operation as the retry operation, and when this "predetermined condition" is not satisfied, the controlling unit 70 performs the normal retry operation as the retry operation. Moreover, the controlling unit 70 controls, upon determining that the current state of at least one of the storing units 10 for which the same denomination has been set is the confirmed empty state or the temporary confirmed empty state, the ejecting mechanism 19 so that, when ejecting the next roll of coins of the same denomination from the storing unit 10, a roll of coins is ejected in a preferential manner from a storing unit 10 other than the storing unit 10 of which the confirmed state has been determined as the confirmed empty state or the temporary confirmed empty state.

Subsequently, an operation performed when a roll of coins is fed from each of the storing units 10 of the coin-roll ejecting device 1 according to the present embodiment is explained by using the flowcharts of FIGS. 11 and 12.

At first, an operation performed when performing the ejection operation of a roll of coins from the coin-roll ejecting device 1 for the first time after the rolls of coins have been replenished in each of the storing units 10 of the coin-roll ejecting device 1 is explained. When information relating to the number of rolls of coins of each of the denominations that should be ejected from the coin-roll ejecting device 1 is input by the operator by using the operating unit 72 (or the operation and displaying unit 140 of the money changer 100), or when the information relating to the number of rolls of coins of each of the denominations that should be ejected from the coin-roll ejecting device 1 is received by the controlling unit 70 via the communication interface unit 78 from the host device, the controlling unit 70 drives the driving unit 21 of the ejecting mechanism 19 of the storing unit 10 from which the roll of coins that should be ejected from the coin-roll ejecting device 1 is stored. Accordingly, the rotating member 20 is rotated in the ejection direction (the counterclockwise direction in FIG. 1) of the roll of coins whereby one or more rolls of coins is ejected one by one from the storing unit 10 (STEP1). When all of the rolls of coins of the predetermined number ejected from the storing unit 10 by the ejecting mechanism 19 are detected by the ejected coin-roll detecting unit 84 of the lifting unit 80 (STEP2: YES), the controlling unit 70 determines that the roll of coins had been stored in the storing unit 10 (STEP6). On the other hand, when all or a part of the rolls of coins of the predetermined number are not detected by the ejected coin-roll detecting unit 84 even after the rotating member 20 of the ejecting mechanism 19 is rotated in the ejection direction of the roll of coins (STEP2: NO), the controlling unit 70 performs the retry operation that includes performing once or multiple times a combination of each of the operation to rotate the rotating member 20 in the direction opposite to the ejection direction of the roll of coins and the operation to rotate the rotating member 20 in the ejection direction of the roll of coins. More particularly, when the same denomination of the roll of coins has been set in a plurality of the storing units 10 and when the rolls of coins of the same denomination are ejected from the storing unit 10 for which the same denomination has been set (STEP3: YES), the controlling unit 70 performs the simpler retry operation (STEP4). On the other hand, when the same denomination of the roll of coins has not been set in a plurality of the storing units 10, or when the same denomination of the roll of coins has been set in a plurality of the storing units 10 but ejection of the roll of coins was not performed from those storing units 10 (i.e., when, ejection of the roll of coins was performed from the storing unit 10 other than the storing units 10 for which the same denomination of the roll of coins has been set) (STEP3: NO), the controlling unit 70 performs the normal retry operation (STEP8).

When the controlling unit 70 performs the simpler retry operation (STEP4), if the roll of coins is detected by the ejected coin-roll detecting unit 84 (STEP5: YES), the controlling unit 70 determines that the roll of coins has been stored in the storing unit 10 (STEP6). Specifically, in this case, it is possible that the rolls of coins involved in the bridge phenomenon that has occurred in the storing unit 10 as shown in FIG. 9 have been separated by the simpler retry operation whereby the roll of coins is sent in the notch 24 of the rotating member 20. On the other hand, when the controlling unit 70 performs the simpler retry operation (STEP4), if the roll of coins is not detected by the ejected coin-roll detecting unit 84 (STEP5: NO), the controlling unit 70 determines that the current state of the storing unit 10 is the temporary confirmed empty state (STEP7). The temporary confirmed empty state means that the storing unit 10 is regarded as empty; however, it also refers to a state in which the possibility that the rolls of coins have been stored in the storing unit 10 but the bridge phenomenon has occurred is higher than the same in the confirmed empty state.

On the other hand, when the controlling unit 70 performs the normal retry operation (STEP8), if the roll of coins is detected by the ejected coin-roll detecting unit 84 (STEP9: YES), the controlling unit 70 determines that the roll of coins has been stored in the storing unit 10 (STEP11). Specifically, in this case, it is possible that the rolls of coins involved in the bridge phenomenon that has occurred in the storing unit 10 as shown in FIG. 9 have been separated by the normal retry operation whereby the roll of coins is sent in the notch 24 of the rotating member 20. On the other hand, when the controlling unit 70 performs the normal retry operation (STEP8), if the roll of coins is not detected by the ejected coin-roll detecting unit 84 (STEP9: NO), the controlling unit 70 determines that the current state of the storing unit 10 is the confirmed empty state (STEP10).

When a determination is made by the controlling unit 70 for a given storing unit 10 that it is the confirmed empty state or the temporary confirmed empty state, the information relating to this determination is stored in the memory unit 76. Even if the power of the coin-roll ejecting device 1 is turned off, the door to access each of the storing units 10 of the coin-roll ejecting device 1 is opened/closed, the entire unit of the storing units 10 is drawn out, and the like, the information stored in the memory unit 76 is not reset. On the other hand, when the operator newly replenishes rolls of coins in each of the storing units 10 of the coin-roll ejecting device 1 and inputs information relating to the replenished number of the rolls of coins by using the operating unit 72 and the like, the controlling unit 70 updates the information relating to the inventory amount of the roll of coins stored in the storing unit 10. When this information is updated, the information stored in the memory unit 76 relating to the determination that the storing unit 10 is in one of the plurality of the confirmed states including the confirmed empty state and the temporary confirmed empty state is reset.

When the same denomination of the roll of coins has been set in the plurality of the storing units 10 and when the rolls of coins of the same denomination are ejected from the storing unit 10 for which the same denomination has been set, if the controlling unit 70 determines that the current state of the storing unit 10 is the temporary confirmed empty state (STEP7), the controlling unit 70 attempts to eject the roll of coins from other storing unit 10 in which the roll of coins of the same denomination has been stored. Specifically, when all of the storing units 10 for which the same denomination of the roll of coins has been set are not in the temporary confirmed empty state (STEP12: NO), the controlling unit 70 drives the driving unit 21 of the ejecting mechanism 19 of the other storing unit 10 for which the same denomination of the roll of coins has been set to cause that storing unit 10 to eject the roll of coins (STEP13). On the other hand, when the controlling unit 70 determines that the current state of all the storing units 10, for which the same denomination of the roll of coins has been set, is the temporary confirmed empty state (STEP12: YES), and when the inventory amount of the roll of coins of that denomination is zero (STEP14: NO), it is possible that no roll of coins of this denomination has been stored in any of the storing units 10 of the coin-roll ejecting device 1. In this case, the controlling unit 70 stops the operation of the coin-roll ejecting device 1, and causes the display unit 74 (or the operation and displaying unit 140 of the money changer 100) to display a warning message that no roll of coins of this denomination has been stored in the coin-roll ejecting device 1. On the other hand, when the controlling unit 70 determines that the current state of all the storing units 10, for which the same denomination of the roll of coins has been set, is the temporary confirmed empty state (STEP12: YES), and when the inventory amount of the roll of coins of that denomination is one or more (STEP14: YES), the controlling unit 70 performs the normal retry operation, instead of the simpler retry operation, in all the storing units 10 of that denomination (STEP15). When the inventory amount of the roll of coins of the denomination is one or more, even if the controlling unit 70 has determined that the current state of all the storing units 10, for which the same denomination of the roll of coins has been set, is in the temporary confirmed empty state, in reality, it is possible that the rolls of coins have been stored in at least one of the storing units 10 among the storing units 10 corresponding to this denomination but the bridge phenomenon as shown in FIG. 9 has occurred. In this case, the bridge phenomenon can be relieved by performing the normal retry operation, and the roll of coins may be fed from the storing unit 10 of this denomination.

Subsequently, an operation performed when performing the ejection operation of a roll of coins from the coin-roll ejecting device 1 according to the present embodiment for the second and subsequent time after rolls of coins have been replenished in each of the storing units 10 of the coin-roll ejecting device 1 is explained. When performing the ejection operation of the roll of coins from the coin-roll ejecting device 1 for the second and subsequent time after the rolls of coins have been replenished, an operation that is basically similar to that performed when performing the ejection operation of the roll of coins from the coin-roll ejecting device 1 for the first time. However, when the same denomination of the roll of coins has been set in the plurality of the storing units 10 and if the rolls of coins of the same denomination are to be ejected from the storing unit 10 for which the same denomination has been set, the roll of coins is fed in a preferential manner from the storing unit 10 for which it was determined in the earlier ejection operation of the roll of coins that the roll of coins has been stored in the storing unit 10 (i.e., the storing unit 10 that is determined not to be the temporary confirmed empty state or the confirmed empty state). In this manner, when performing the ejection operation of the roll of coins from the coin-roll ejecting device 1 for the second and subsequent time after the rolls of coins have been replenished, the roll of coins is fed in a preferential manner from the storing unit 10 for which it is determined that it is not the temporary confirmed empty state or the confirmed empty state. As a result, the roll of coins can be surely ejected from the storing unit 10, and the time required to process the roll of coins in the coin-roll ejecting device 1 can be shortened.

Moreover, when performing the ejection operation of the roll of coins from the coin-roll ejecting device 1, if the inventory amount of the roll of coins of that denomination is zero, it is considered that no roll of coins of this denomination has been stored in any of the storing units 10 of the coin-roll ejecting device 1. Instead of performing the ejection operation of the roll of coins from the storing unit 10 by using the ejecting mechanism 19, the warning message that no roll of coins of this denomination has been stored in the coin-roll ejecting device 1 is displayed on the display unit 74 (or the operation and displaying unit 140 of the money changer 100).

According to the coin-roll ejecting device 1 or the coin-roll ejecting method of the present embodiment and having the above-explained configuration, the ejected coin-roll detecting unit 84 that detects the roll of coins ejected from the storing unit 10 by the ejecting mechanism 19 is provided, and the controlling unit 70 determines whether a roll of coins is present in the storing unit 10 based on the detection result of the roll of coins obtained by the ejected coin-roll detecting unit 84. According to this coin-roll ejecting device 1, whether a roll of coins is present in the storing unit 10 can be determined even if no sensor to detect a roll of coins is provided in every storing unit 10 allowing the configuration to be made simpler and the production cost to be reduced.

Moreover, in the coin-roll ejecting device 1 according to the present embodiment, as explained above, the ejected coin-roll detecting unit 84 that detects the roll of coins ejected from the storing unit 10 by the ejecting mechanism 19 is arranged in the coin-roll storing member 82 of the lifting unit 80.

Moreover, in the coin-roll ejecting device 1 according to the present embodiment, as explained above, the controlling unit 70 controls, if the predetermined number of the roll of coins is not detected by the ejected coin-roll detecting unit 84 when the rotating member 20 is rotated by the driving unit 21 in the ejection direction of the roll of coins, the ejecting mechanism 19 to perform the retry operation that includes performing once or multiple times a combination of each of the operation to rotate the rotating member 20 in the direction opposite to the ejection direction of the roll of coins and the operation to rotate the rotating member 20 in the ejection direction of the roll of coins. The controlling unit 70 determines that no roll of coins has been stored in the storing unit 10 when no roll of coins is detected by the ejected coin-roll detecting unit 84 even after performing the retry operation. In this case, even if the bridge phenomenon of the rolls of coins has occurred in the storing unit 10 as shown in FIG. 9, the rolls of coins involved in the bridge phenomenon can be separated by performing the retry operation, and whether a roll of coins has been stored in the storing unit 10 can be determined more precisely. That is, when it is determined without performing the retry operation that no roll of coins has been stored in the storing unit 10 because the predetermined number of the roll of coins was not detected by the ejected coin-roll detecting unit 84 when the rotating member 20 was rotated in the ejection direction of the roll of coins by the driving unit 21, there is a possibility that it is wrongly determined that no roll of coins has been stored in the storing unit 10 in the event that the bridge phenomenon of the rolls of coins has occurred in the storing unit 10 as shown in FIG. 9. In this case, there is a possibility that the real inventory amount may be different from the inventory amount of each of the denominations of the roll of coins managed by the controlling unit 70. In contrast, when the determination whether a roll of coins has been stored in the storing unit 10 is made after performing the retry operation, even if the bridge phenomenon of the rolls of coins has occurred in the storing unit 10 as shown in FIG. 9, the rolls of coins involved in the bridge phenomenon can be separated by performing the retry operation. Therefore, it can be prevented that the real inventory amount differs from the inventory amount of each of the denominations of the roll of coins managed by the controlling unit 70.

Moreover, in the coin-roll ejecting device 1 according to the present embodiment, as explained above, in the storing units 10, the rolls of coins are stored on the bottom surface 12 in a piled-up manner and along the rolling direction of the inclined bottom surface 12 with respect to the horizontal plane. The gate unit 30 is arranged above the rotating member 20. This gate unit 30 prevents a situation where the roll of coins stored in the storing unit 10 does not enter into the notches 24 of the rotating member 20 whereby the roll of coins is ejected from above the rotating member 20. Moreover, the gate unit 30 moves following the rotation motion of the rotating member 20. In this case, even if the bridge phenomenon of the rolls of coins has occurred in the storing unit 10 as shown in FIG. 9, the rolls of coins involved in the bridge phenomenon can be separated by the gate unit 30.

Moreover, in the coin-roll ejecting device 1 according to the present embodiment, as explained above, a plurality of retry operations is set previously in the controlling unit 70 as the retry operation, and each of the plurality of retry operations includes the operation to rotate the rotating member 20 in the direction opposite to the ejection direction of the roll of coins having a different duration and/or times and/or the operation to rotate the rotating member 20 in the ejection direction of the roll of coins having a different duration and/or times. The controlling unit 70 selects, if the predetermined number of the roll of coins is not detected by the ejected coin-roll detecting unit 84 when the rotating member 20 is rotated by the driving unit 21 in the ejection direction of the roll of coins, one retry operation among the plurality of the retry operations set previously based on whether a predetermined condition is satisfied as the retry operation to be performed. Specifically, in the controlling unit 70 are set, as the retry operations, the normal retry operation and the simpler retry operation in which the duration and/or times to rotate the rotating member 20 in the direction opposite to the ejection direction of the roll of coins and the duration and/or times to rotate the rotating member 20 in the ejection direction of the roll of coins are shorter/fewer than those in the normal retry operation. The controlling unit 70 determines, upon determining that no roll of coins has been stored in the storing unit 10, that the current state of the storing unit 10 is the confirmed empty state when the normal retry operation has been performed and determines that the current state of the storing unit 10 is the temporary confirmed empty state when the simpler retry operation has been performed. The "predetermined condition" is that, when the same denomination of the roll of coins is set in the plurality of the storing units 10, ejecting the roll of coins from the storing unit 10 for which the same denomination has been set. When such a "predetermined condition" is satisfied, in performing the ejection operation of the roll of coins from the plurality of the storing units 10 for which the same denomination has been set, the simpler retry operation has been performed. Accordingly, even if no roll of coins is stored in a certain storing unit 10, the ejection operation of the roll of coins can be performed from another storing unit 10 in a short time. Therefore, the time required to perform the ejection operation of the roll of coins in each of the storing units 10 can be shortened in comparison with the case when the normal retry operation has been performed. For example, consider a case in which JPY 100 is set as the denomination of the roll of coins for three storing units 10, and that the rolls of coins of JPY 100 are stored in only one of these storing units 10. In this case, in performing an ejection operation of the roll of coins of JPY 100 from the coin-roll ejecting device 1, the ejection operation of the roll of coins is performed sequentially from those storing units 10 for which the roll of coins of JPY 100 has been set. However, in doing so, because the simpler retry operation is performed for those storing units 10 in which no roll of coins has been stored, the time required to eject the roll of coins from the storing unit 10 in which the rolls of coins have been stored will be shortened in comparison with the case when the normal retry operation is performed.

Moreover, in this case, when the same denomination of the roll of coins has been set in the plurality of the storing units 10, upon determining that the current state of at least one of the storing units 10 for which the same denomination has been set is the confirmed empty state or the temporary confirmed empty state, the controlling unit 70 controls the ejecting mechanism 19 so that, when ejecting the next roll of coins of the same denomination from the storing unit 10, a roll of coins is ejected in a preferential manner from a storing unit 10 other than the storing unit 10 of which the confirmed state has been determined as the confirmed empty state or the temporary confirmed empty state. In this manner, the roll of coins is fed in a preferential manner from the storing unit 10 for which it is determined that it is not in the temporary confirmed empty state or the confirmed empty state. As a result, the roll of coins can be surely ejected from the storing unit 10, and the time required to perform the ejection operation of the roll of coins can be shortened.

Moreover, in the coin-roll ejecting device 1 according to the present embodiment, as explained above, in the controlling unit 70, when the information relating to the inventory amount of the roll of coins stored in the storing unit 10 is updated, the information relating to the determination that the storing unit 10 is in one of the plurality of the confirmed states including the confirmed empty state and the temporary confirmed empty state is reset.

Moreover, in the coin-roll ejecting device 1 according to the present embodiment, as explained above, in the controlling unit 70, when the setting is made so that the rolls of coins of the same denomination are to be stored in the plurality of the storing units 10, by inputting the total number of the rolls of coins of the same denomination that have been stored in the plurality of the storing units 10, it is possible to perform the inventory management of the rolls of coins of each of the denominations. In this case, when the operator replenishes the rolls of coins in the coin-roll ejecting device 1, because there is no need to input the replenished number of the rolls of coins for each of the storing units 10 for which the same denomination has been set, the workload of the operator can be reduced and the convenience can be improved.

Moreover, in this case, the controlling unit 70 can determine, when ejecting the roll of coins of a given denomination from the storing unit 10, whether the roll of coins is to be ejected from the storing unit 10 based on the inventory amount of the roll of coins of the given denomination. That is, no roll of coins is ejected from the storing unit 10 for which the inventory amount of the roll of coins of the denomination that is about to be ejected from that storing unit 10 is zero. In this manner, waste of time in driving the ejecting mechanism 19 though no roll of coins has been stored in the storing unit 10 can be prevented.

Moreover, the controlling unit 70 controls, when ejecting the roll of coins of a given denomination from the storing unit 10, if the inventory amount of the roll of coins of that denomination is one or more but it is determined that no roll of coins is stored in any of the storing units 10 corresponding to the denomination, the ejecting mechanism 19 to eject the roll of coins from the storing unit 10 corresponding to the denomination. That is, when ejecting the roll of coins of a given denomination from the storing unit 10, even if the controlling unit 70 has determined that no roll of coins has been stored in any of the storing units 10 corresponding to the denomination, if the inventory amount of the roll of coins of the denomination is one or more, it means that in reality the roll of coins has been stored in at least one of the storing units 10 corresponding to the denomination. Therefore, the ejecting mechanism 19 is controlled to eject the roll of coins from the storing unit 10 corresponding to the denomination. In this manner, when ejecting the roll of coins of a given denomination from the storing unit 10, it can be prevented that the ejection operation of the roll of coins from the storing unit 10 is not performed though in reality the roll of coins of the denomination is stored in the storing unit 10.

Moreover, in the coin-roll ejecting device 1 according to the present embodiment, as explained above, the information relating to the determination made by the controlling unit 70 that no roll of coins has been stored in the storing unit 10 is stored in the memory unit 76, and the information relating to the determination stored in the memory unit 76 that no roll of coins has been stored in the storing unit 10 is retained until the specific instruction is given to the controlling unit 70. In this case, even if the power of the coin-roll ejecting device 1 is turned off, the door to access each of the storing units 10 of the coin-roll ejecting device 1 is opened/closed, the entire unit of the storing units 10 is drawn out, and the like, the information relating to the determination that no roll of coins has been stored in the storing unit 10 is retained. Therefore, the ejection operation of the roll of coins from each of the storing units 10 after restarting the coin-roll ejecting device 1 after turned off the power of the coin-roll ejecting device 1 can be performed smoothly based on the information stored in the memory unit 76.

The coin-roll ejecting device 1 and the coin-roll ejecting method according to the present embodiment are not limited to the above-explained embodiments and various changes can be made as appropriate.

For example, in the above explanation, an example in which the ejected coin-roll detecting unit 84, which detects the roll of coins ejected from the storing unit 10 by the ejecting mechanism 19, is arranged in the coin-roll storing member 82 of the lifting unit 80; however, the configuration is not limited to this example. As a variation of the coin-roll ejecting device, the ejected coin-roll detecting unit, which detects the roll of coins ejected from the storing unit 10 by the ejecting mechanism 19, can be arranged at a location other than in the coin-roll storing member 82 of the lifting unit 80.

Moreover, in the above explanation, the gate unit 30 is swung around a horizontally-extending shaft center following the rotation motion of the rotating member 20 to separate the rolls of coins involved in the bridge phenomenon by the gate unit 30 when the bridge phenomenon of the rolls of coins has occurred in the storing unit 10 as shown in FIG. 9; however, the configuration is not limited to this example. As another variation of the coin-roll ejecting device, a mechanism other than the gate unit 30 can be used as the mechanism that separates the rolls of coins involved in the bridge phenomenon occurring in the storing unit 10.

Moreover, even if the gate unit 30 is omitted, because the outer surface 26 of the rotating member 20 is configured so that a distance thereof from the center of the rotation axis 22 as a shaft center changes, the position of the roll of coins that is in contact with the outer surface 26 is shifted when the rotating member 20 rotates around the rotation axis 22. Therefore, if a large number of the rolls of coins have been stored in the storing unit 10 piled-up in several layers, based on a storing state of the rolls of coins in the storing unit 10, the rolls of coins cannot move within the storing unit 10, and the roll of coins may not enter the notch 24 though this notch 24 of the rotating member 20 is empty. However, because even the position of the roll of coins that is in contact with the outer surface 26 is shifted when the rotating member 20 rotates around the rotation axis 22, the rolls of coins are stirred and caused to move within the storing unit 10, and the roll of coins can be sent in the notch 24 of the rotating member 20. In this manner, the principle of the present invention can be applied even when the gate unit 30 is omitted.

Moreover, an example is explained above in which, if the predetermined number of the roll of coins is not detected by the ejected coin-roll detecting unit 84 when the rotating member 20 is rotated by the driving unit 21 in the ejection direction of the roll of coins, one retry operation between the two kinds of the retry operations of the simpler retry operation and the normal retry operation is performed as the retry operation; however, the configuration is not limited to this example. As still another variation of the coin-roll ejecting device, as the retry operation, three or more kinds of retry operations each including the operation to rotate the rotating member 20 in the direction opposite to the ejection direction of the roll of coins having a different duration and/or times and/or the operation to rotate the rotating member 20 in the ejection direction of the roll of coins having a different duration and/or times can be set in the controlling unit 70, and one retry operation among those three or more kinds of the retry operations can be performed. Moreover, in this case, upon determining that no roll of coins has been stored in the storing unit 10, it can be determined that the storing unit 10 is in one of the plurality of confirmed states having various levels each corresponding to each of the three or more kinds of the retry operations.

The invention claimed is:

1. A coin-roll ejecting device comprising:

a storing unit that stores therein an unknown number of rolls of coins and having an ejecting mechanism for ejecting the stored rolls of coins one by one, the ejecting mechanism comprising:

a rotating member having a notch for receiving the roll of coins one by one that is stored in the storing unit, and that rotates around a shaft center that extends horizontally; and a driving unit that rotates the rotating member around the shaft center in an ejection direction of the roll of coins or in a direction opposite to the ejection direction;

an ejected coin-roll detecting unit that detects a roll of coins ejected from the storing unit by the ejecting mechanism; and a controlling unit that determines whether a roll of coins is present in the storing unit based on a detection result of the roll of coins obtained by the ejected coin-roll detecting unit, wherein when ejecting a predetermined number of the roll of coins by the ejecting mechanism, if the predetermined number of the roll of coins is not detected by the ejected coin-roll detecting unit, the controlling unit determines that the storing unit is empty, and the controlling unit controls, when the rotating member is rotated by the driving unit in the ejection direction of the roll of coins and if a predetermined number of the roll of coins is not detected by the ejected coin-roll detecting unit, the ejecting mechanism to perform a retry operation that comprises performing once or multiple times a combination of each of an operation to rotate the rotating member in the direction opposite to the ejection direction of the roll of coins and an operation to rotate the rotating member in the ejection direction of the roll of coins, and determines that no roll of coins is stored in the storing unit when the predetermined number of the roll of coins is not detected by the ejected coin-roll detecting unit even after the retry operation has been performed.

2. The coin-roll ejecting device as claimed in claim 1, further comprising a lifting unit comprising a coin-roll storing member for storing therein the roll of coins ejected from the storing unit by the ejecting mechanism, and that is movable in a vertical direction, wherein the ejected coin-roll detecting unit is arranged in the coin-roll storing member of the lifting unit.

3. The coin-roll ejecting device as claimed in claim 1, wherein the storing unit comprises a bottom surface that is inclined with respect to a horizontal plane, and a plurality of the rolls of coins is stored on the bottom surface in a piled-up manner and along a rolling direction parallel to the inclined bottom surface.

4. The coin-roll ejecting device as claimed in claim 3, further comprising a gate unit arranged above the rotating member and that prevents a situation where the roll of coins stored in the storing unit does not enter into the notch of the rotating member whereby the roll of coin is ejected from above the rotating member, wherein the gate unit moves following a rotation motion of the rotating member.

5. The coin-roll ejecting device as claimed in claim 1, wherein a plurality of retry operations is set previously in the controlling unit as the retry operation, each of the plurality of retry operations including a combination of the operation to rotate the rotating member in the direction opposite to the ejection direction of the roll of coins having a different duration and/or times and/or the operation to rotate the rotating member in the ejection direction of the roll of coins having a different duration and/or times, and the controlling unit selects one among the retry operations set previously based on whether a predetermined condition is satisfied, the retry operation being performed, if a predetermined number of the roll of coins is not detected by the ejected coin-roll detecting unit when the rotating member is rotated by the driving unit in the ejection direction of the roll of coins.

6. The coin-roll ejecting device as claimed in claim 5, wherein the storing unit comprises a plurality of storing units each storing a roll of coins of a preset denomination, and the predetermined condition is to eject the roll of coins from the storing units for which the same denomination has been set when the same denomination of the roll of coins is set in the plurality of the storing units.

7. The coin-roll ejecting device as claimed in claim 5, wherein the controlling unit determines based on the kind of the performed retry operation that a current state of the storing unit is one of a plurality of confirmed states including a confirmed empty state and a temporary confirmed empty state, upon determining that no roll of coins has been stored in the storing unit.

8. The coin-roll ejecting device as claimed in claim 7, wherein the types of the retry operations are set in the controlling unit as a normal retry operation and a simpler retry operation in which the duration and/or times to rotate the rotating member in the direction opposite to the ejection direction of the roll of coins and/or the duration and/or times to rotate the rotating member in the ejection direction of the roll of coins are shorter/fewer than those in the normal retry operation, and the controlling unit determines that the current state of the storing unit is the confirmed empty state when the normal retry operation has been performed and determines that the current state of the storing unit is the temporary confirmed empty state when the simpler retry operation has been performed, upon determining that no roll of coins has been stored in the storing unit.

9. The coin-roll ejecting device as claimed in claim 7, wherein when the same denomination of the roll of coins is set in a plurality of the storing units and when the controlling unit has determined that the current state of at least one of the storing units for which the same denomination of the roll of coins has been set is the confirmed empty state or the temporary confirmed empty state, the controlling unit controls the ejecting mechanism so that when the next roll of coins of the same denomination is ejected from the storing unit, the roll of coins is ejected in a preferential manner from a storing unit other than the storing unit of which the confirmed state has been determined as the confirmed empty state or the temporary confirmed empty state.

10. The coin-roll ejecting device as claimed in claim 7, wherein when information relating to an inventory amount of the roll of coins stored in the storing unit is updated in the controlling unit, the controlling unit resets information relating to a determination that the storing unit is in one of the plurality of the confirmed states including the confirmed empty state or the temporary confirmed empty state.

11. The coin-roll ejecting device as claimed in claim 1, wherein the storing unit comprises a plurality of storing units each storing a roll of coins of a preset denomination, and when the same denomination of roll of coins is set in a plurality of the storing units in the controlling unit, the controlling unit is capable of performing an inventory management of the roll of coins of each of the denominations by inputting a total number of roll of coins of the same denomination stored in the storing units.

12. The coin-roll ejecting device as claimed in claim 11, wherein when a roll of coins of a given denomination is to be ejected from the storing unit, the controlling unit determines whether to eject the roll of coins from that storing unit based on the inventory amount of the roll of coins of the given denomination and based on a determination result relating to whether the roll of coins has been stored in that storing unit.

13. The coin-roll ejecting device as claimed in claim 12, wherein when a roll of coins of a given denomination is to be ejected from the storing unit, the controlling unit controls the ejecting mechanism to eject the roll of coins from the storing unit corresponding to the given denomination upon determining that the inventory amount of the roll of coins of the given denomination is one or more, and upon determining that no roll of coins has been stored in any of the storing units corresponding to the given denomination.

14. The coin-roll ejecting device as claimed in claim 1, further comprising a memory unit that stores therein information relating to a determination made by the controlling unit that no roll of coins has been stored in the storing unit, wherein the information stored in the memory unit relating to the determination that no roll of coins has been stored in the storing unit is retained therein until a specific instruction is given to the controlling unit.

15. A money processing machine comprising the coin-roll ejecting device as claimed in claim 1.

16. A coin-roll ejecting method implemented in a coin-roll ejecting device including a storing unit that stores therein an unknown number of rolls of coins and having an ejecting mechanism for ejecting the stored rolls of coins one by one, comprising:

detecting with an ejected coin-roll detecting unit a roll of coins ejected from the storing unit by the ejecting mechanism, the ejecting mechanism comprising:

a rotating member having a notch for receiving the roll of coins one by one that is stored in the storing unit, and that rotates around a shaft center that extends horizontally; and a driving unit that rotates the rotating member around the shaft center in an ejection direction of the roll of coins or in a direction opposite to the ejection direction; and determining whether the storing unit is empty based on a detection result of the roll of coins obtained by the ejected coin-roll detecting unit, wherein when ejecting a predetermined number of the roll of coins by the ejecting mechanism, if the predetermined number of the roll of coins is not detected by the ejected coin-roll detecting unit, it is determined that the storing unit is empty, and when the rotating member is rotated by the driving unit in the ejection direction of the roll of coins and if a predetermined number of the roll of coins is not detected by the ejected coin-roll detecting unit, the ejecting mechanism performs a retry operation that comprises performing once or multiple times a combination of each of an operation to rotate the rotating member in the direction opposite to the ejection direction of the roll of coins and an operation to rotate the rotating member in the ejection direction of the roll of coins, and it is determined that no roll of coins is stored in the storing unit when the predetermined number of the roll of coins is not detected by the ejected coin-roll detecting unit even after the retry operation has been performed.

* * * * *